US010643815B2

(12) United States Patent
Nakamatsu et al.

(10) Patent No.: US 10,643,815 B2
(45) Date of Patent: May 5, 2020

(54) ELECTRON EMISSION DEVICE, METHOD FOR MANUFACTURING SAME, AND METHOD FOR MANUFACTURING ELECTRONIC DEVICE

(71) Applicant: SHARP KABUSHIKI KAISHA, Sakai, Osaka (JP)

(72) Inventors: Kenichiro Nakamatsu, Sakai (JP); Hidekazu Hayashi, Sakai (JP); Tokio Taguchi, Sakai (JP); Tadashi Iwamatsu, Sakai (JP); Kohji Shinkawa, Sakai (JP); Mai Takasaki, Sakai (JP); Toshihiro Kaneko, Sakai (JP); Atsushi Niinoh, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/127,670

(22) Filed: Sep. 11, 2018

(65) Prior Publication Data

US 2019/0080870 A1 Mar. 14, 2019

(30) Foreign Application Priority Data

Sep. 11, 2017 (JP) ..... 2017-174115

(51) Int. Cl.
*H01J 9/02* (2006.01)
*H01J 1/308* (2006.01)
(Continued)

(52) U.S. Cl.
CPC ..... *H01J 9/025* (2013.01); *H01J 1/308* (2013.01); *H01J 1/3048* (2013.01); *G03G 15/02* (2013.01)

(58) Field of Classification Search
CPC ..... H01J 9/025; H01J 1/3048
(Continued)

(56) References Cited

U.S. PATENT DOCUMENTS 7,267,859 B1 * 9/2007 Rabin ..... B82Y 30/00 428/131
7,679,077 B2 * 3/2010 Yao ..... B82Y 10/00 257/15
(Continued)

FOREIGN PATENT DOCUMENTS

JP 2001-143600 A 5/2001
JP 2003-229045 A 8/2003
(Continued)

OTHER PUBLICATIONS

Co-pending letter refarding a related co-pending U.S. Appl. No. 16/613,540, filed Nov. 14, 2019.
(Continued)

*Primary Examiner* — Christopher M Raabe
(74) *Attorney, Agent, or Firm* — ScienBiziP, P.C.

(57) ABSTRACT

Provided are an electron emission device having a novel structure and being capable of improving characteristics and/or extending a lifetime of a related-art electron emission device, and a method of manufacturing the electron emission device. The method of manufacturing an electron emission device includes: a step A of providing one of an aluminum substrate and an aluminum layer supported by a substrate; a step B of anodizing a surface of the one of the aluminum, substrate and the aluminum layer to form a porous alumina layer having a plurality of pores; a step C of applying silver nanoparticles into the plurality of pores to cause the plurality of pores to support the silver nanoparticles; a step D of applying, after the step C, an insulating layer forming solution to substantially an entire surface of the one of the aluminum substrate and the aluminum layer; a step E of forming, after the step D, an insulating layer by at least reducing a solvent included in the insulating layer
(Continued)

forming solution; and a step F of forming an electrode on the insulating layer.

14 Claims, 11 Drawing Sheets

(51) Int. Cl.
*H01J 1/304* (2006.01)
*G03G 15/02* (2006.01)

(58) Field of Classification Search
USPC ..... 313/346 R
See application file for complete search history.

(56) References Cited

U.S. PATENT DOCUMENTS 9,930,936 B2 * 4/2018 Liu ..... A44B 11/006
2005/0067935 A1 * 3/2005 Lee ..... H01J 1/3044 313/309
2006/0138664 A1 6/2006 Ito et al.
2007/0200478 A1 * 8/2007 Dijon ..... B82Y 10/00 313/311
2008/0067912 A1 * 3/2008 Ishida ..... H01J 1/304 313/309
2010/0278561 A1 11/2010 Kanda et al.

FOREIGN PATENT DOCUMENTS

JP 2004-014406 A 1/2004
JP 2004-178863 A 6/2004
JP 2009-146891 A 7/2009
JP 2016-136485 A 7/2016

OTHER PUBLICATIONS

Tadashi Iwamatsu et al. "Novel Charging System by Electron Emission Device in the Atmosphere", The Imaging Society of Japan, vol. 56, No. 1:16-23 (2017).
U.S. Appl. No. 16/613,540, filed Nov. 14, 2019.

* cited by examiner

ELECTRON EMISSION DEVICE, METHOD FOR MANUFACTURING SAME, AND METHOD FOR MANUFACTURING ELECTRONIC DEVICE

BACKGROUND

1. Technical Field

The present invention relates to an electron emission device, a method of manufacturing the same, and a method of manufacturing an electronic device.

2. Description of the Related Art

The applicant of the subject application has developed an electron emission device having a novel structure and being operable in the atmosphere (for example, see Japanese Patent Application Laid-open No. 2009-146891 (Japanese Patent No. 4303308) and Japanese Patent Application Laid-open No. 2016-136485).

The electron emission device described in Japanese Patent Application Laid-open No. 2016-136485 includes a semi-conductive layer, which is arranged between a pair of electrodes (substrate electrode and surface electrode), and in which conductive nanoparticles are dispersed in an insulating material. When a voltage of about several tens of volts is applied to the semi-conductive layer, electrons can be emitted from the surface electrode (field electron emission). Therefore, this electron emission device has an advantage in that no ozone is generated unlike a related-art electron emission device (for example, a corona discharger) using a discharge phenomenon under an intense electric field.

This electron emission device may be suitably used as, for example, a charging device for charging a photosensitive drum in an image forming apparatus (for example, a copier). In Tadashi Iwamatsu et al., Journal of the Imaging Society of Japan 56(1), pp. 16-23, 2017, the electron emission device including the surface electrode having the layered structure described in Japanese Patent Application Laid-open No. 2016-136485 may have a lifetime of about 300 hours (about 300,000 sheets in a medium-speed copier) or more.

SUMMARY

However, there is a demand for the above-mentioned electron emission device to have improved characteristics and/or a longer lifetime. In view of this, one embodiment of the present invention has an object to provide an electron emission device having a novel structure and being capable of improving the characteristics and/or extending the lifetime of the above-mentioned electron emission device, and a method of manufacturing the electron emission device. Another embodiment of the present invention provides a method of manufacturing an electronic device, which is capable of suppressing occurrence of a trouble of failure of normal drive.

According to one embodiment of the present invention, there is provided a method of manufacturing an electron emission device, including: a step A of providing one of an aluminum substrate and an aluminum layer supported by a substrate; a step B of anodizing a surface of the one of the aluminum substrate and the aluminum layer to form a porous alumina layer having a plurality of pores; a step C of applying silver nanoparticles into the plurality of pores to cause the plurality of pores to support the silver nanoparticles; a step D of applying, after the step C, an insulating layer forming solution to substantially an entire surface of the one of the aluminum substrate and the aluminum layer; a step E of forming, after the step D, an insulating layer by at least reducing a solvent included in the insulating layer forming solution; and a step F of forming, after the step E, an electrode on the insulating layer.

In one embodiment, the step D includes performing one of coating and printing of the insulating layer forming solution.

In one embodiment, the step D includes coating substantially the entire surface with the insulating layer forming solution by spin coating.

In one embodiment, the step F includes: a step F1 of depositing a conductive film on the insulating layer; and a step F2 of patterning the conductive film to form the electrode.

In one embodiment, the electrode includes metal.

In one embodiment, the surface of the one of the aluminum substrate and the aluminum layer provided in the step A is partially covered by an interelectrode insulating layer.

In one embodiment, the step A includes: a step A1 of providing the one of the aluminum substrate and the aluminum layer supported by the substrate; and a step A2 of forming the interelectrode insulating layer, the step A2 including forming the interelectrode insulating layer including an anodized layer formed by anodizing a part of the surface of the one of the aluminum substrate and the aluminum layer provided in the step A1.

In one embodiment, the step E includes baking the insulating layer forming solution.

In one embodiment, the step E includes baking the insulating layer forming solution at 220° C. or less.

In one embodiment, the step E includes baking the insulating layer forming solution at a temperature equal to or higher than a boiling point of the solvent.

In one embodiment, the insulating layer forming solution includes a polymer including a siloxane bond.

In one embodiment, the step B further includes performing etching after the anodization.

In one embodiment, the step B further includes performing anodization after the etching.

According to one embodiment of the present invention, there is provided an electron emission device, including: a first electrode; a second electrode; and a semi-conductive layer formed between the first electrode and the second electrode, the first electrode being formed of one of an aluminum substrate and an aluminum layer, the semi-conductive layer including: a porous alumina layer, which is formed on a surface of the one of the aluminum substrate and the aluminum layer, and has a plurality of pores; and silver nanoparticles supported in the plurality of pores, the electron emission device further including an insulating layer formed on the porous alumina layer and in the plurality of pores.

In one embodiment, the insulating layer includes a polymer including a siloxane bond.

In one embodiment, the insulating layer is substantially free from carbon.

According to one embodiment of the present invention, there is provided a method of manufacturing an electronic device, including: a step (a) of providing one of an aluminum substrate and an aluminum layer supported by a substrate; a step (b) of anodizing a surface of the one of the aluminum substrate and the aluminum layer to form a porous alumina layer having a plurality of pores; a step (c) of applying, after the step (b), an insulating layer forming solution to substantially an entire surface of the one of the aluminum substrate and the aluminum layer; a step (d) of forming, after the step (c), an insulating layer by at least reducing a solvent included in the insulating layer forming solution; and a step (e) of forming, after the step (d), one of a semiconductor layer and a conductive layer on the insulating layer.

An electron emission device according to another embodiment of the present invention includes: a first electrode; a second electrode; and a semi-conductive layer formed between the first electrode and the second electrode. The semi-conductive layer includes a porous alumina layer having a plurality of pores, and silver supported in the plurality of pores of the porous alumina layer. The first electrode is formed of an aluminum substrate having an aluminum, content of 99.00 mass % or more and less than 99.99 mass %, and the porous alumina layer is an anodized layer formed on a surface of the aluminum substrate.

In one embodiment, the aluminum content of the aluminum substrate is 99.98 mass % or less.

In one embodiment, the porous alumina layer has a thickness of 10 nm or more and 5 μm or less.

In one embodiment, the plurality of pores each have an opening having a two-dimensional size of 50 nm or more and 3 μm or less as viewed in a direction normal to the surface.

In one embodiment, the plurality of pores of the porous alumina layer each have a depth of 10 nm or more and 5 μm or less. The plurality of pores of the porous alumina layer may each have a depth of 50 nm or more and 500 nm or less.

In one embodiment, the porous alumina layer includes a barrier layer having a thickness of 1 nm or more and 1 μm or less. The porous alumina layer may include a barrier layer having a thickness of 100 nm or less.

In one embodiment, the plurality of pores of the porous alumina layer each have a step-like side surface. The plurality of pores each have at least two pore parts having different pore diameters in a depth direction, and a pore diameter is smaller as the pore part is located at a deeper position.

In one embodiment, the silver is silver nanoparticles having an average particle diameter of 1 nm or more and 50 nm or less. The silver may be silver nanoparticles having an average particle diameter of 3 nm or more and 10 nm or less.

In one embodiment, the second electrode includes gold. The second electrode has a layered structure described in Japanese Patent Application Laid-open No. 2016-136485.

A method of manufacturing an electron emission device according to another embodiment of the present invention is a method of manufacturing any one of the above-mentioned electron emission devices, and the method includes: a step of providing an aluminum substrate having an aluminum content of 99.00 mass % or more and less than 99.99 mass %; a step of forming a porous alumina layer by anodizing a surface of the aluminum substrate; and a step of applying silver nanoparticles into a plurality of pores of the porous alumina layer.

In one embodiment, the aluminum content of the aluminum substrate is 99.98 mass % or less.

In one embodiment, the step of forming the porous alumina layer includes performing anodization and performing etching after the anodization.

In one embodiment, the step of forming the porous alumina layer further includes performing anodization after the etching.

According to one embodiment of the present invention, the electron emission device having a novel structure and the method of manufacturing the same, which are capable of improving the characteristics and/or extending the lifetime of the above-mentioned related art, are provided. According to another embodiment of the present invention, the method of manufacturing an electronic device, which is capable of suppressing occurrence of a trouble of failure of normal drive, is provided.

DETAILED DESCRIPTION

Now, an electron emission device and a method of manufacturing the same according to embodiments of the present invention are described with reference to the drawings. Embodiments of the present invention are not limited to those exemplified here. In the following description, components having similar functions are denoted by common reference symbols, and redundant description thereof is omitted.

Figure 1:
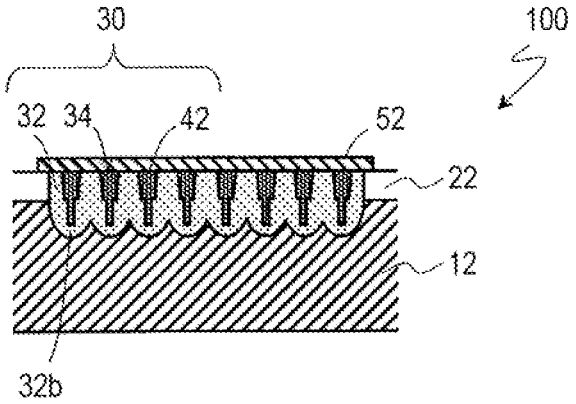
FIG. 1 is a schematic sectional view for illustrating an electron emission device 100 according to an embodiment of the present invention.

FIG. 1 is a schematic sectional view for illustrating an electron emission device 100 according to an embodiment of the present invention.

The electron emission device 100 includes a first electrode 12, a second electrode 52, and a semi-conductive layer 30 formed between the first electrode 12 and the second electrode 52. The first electrode 12 is formed of, for example, an aluminum substrate (having a thickness of, for example, 0.5 nm), and the second electrode 52 is formed of, for example, a gold (Au) layer (having a thickness of, for example, 40 nm). An insulating layer 22 may function as a device isolating layer when a plurality of electron emission devices 100 are manufactured on the aluminum substrate. The size of one electron emission device 100 (size of a region surrounded by the insulating layer 22) is, for example, (about 5 mm)×(about 5 mm) (5 mm□), and the width of the insulating layer 22 is about 5 mm. The insulating layer 22 may be omitted when a single electron emission device 100 is to be formed, but with the insulating layer 22, advantages such as suppression of electric field concentration and generation of a leakage current between the first electrode 12 and the second electrode 52 may be obtained.

The semi-conductive layer 30 includes a porous alumina layer 32 having a plurality of pores 34, and silver (Ag) 42 supported in the plurality of pores 34 of the porous alumina layer 32.

The plurality of pores 34 each have, for example, an opening having a two-dimensional size (Dp) of about 50 nm or more and about 3 μm or less as viewed in a direction normal to the surface. The plurality of pores 34 may each have an opening having a two-dimensional size (Dp) of less than about 500 nm as viewed in the direction normal to the surface. The opening herein refers to a top portion of the pore 34. When the pore 34 has at least two pore parts having different pore diameters in a depth direction, of the pore diameters, the pore diameter of the top portion is called an opening diameter. The "two-dimensional size" refers to an area circle-equivalent diameter of the opening (pore 34) as viewed in the direction normal to the surface. In the following description, the two-dimensional size, the opening diameter, or the pore diameter refers to the area circle-equivalent diameter. Details of the porous alumina layer 32 are described later with reference to FIG. 3A to FIG. 3C.

Silver supported in the pore 34 is, for example, silver nanoparticles (hereinafter referred to as "Ag nanoparticles"). It is preferred that the Ag nanoparticles have an average particle diameter of, for example, 1 nm or more and 50 nm or less. It is further preferred that the Ag nanoparticles have an average particle diameter of, for example, 3 nm or more and 10 nm or less. The Ag nanoparticles may be covered with an organic compound (for example, an alcohol derivative and/or a surfactant).

The first electrode 12 is formed of, for example, an aluminum substrate (having a thickness of, for example, 0.5 mm), and the porous alumina layer 32 is an anodized layer formed at the surface of the aluminum substrate. An aluminum layer formed on a substrate (for example, a glass substrate) may be used instead of the aluminum substrate. That is, the porous alumina layer 32 may be an anodized layer formed at the surface of the aluminum layer supported by the substrate. When the substrate is an insulating substrate like a glass substrate, a conductive layer may be formed between the aluminum layer and the substrate so that the aluminum layer and the conductive layer may be used as electrodes. It is preferred that the thickness of the aluminum layer functioning as the electrode (part remaining after anodization) be, for example, 10 μm or more.

The second electrode 52 is formed of, for example, a gold (Au) layer. The thickness of the Au layer is preferred to be 10 nm or more and 100 nm or less, and is, for example, 40 nm. Alternatively, platinum (Pt) may be used. Further, the second electrode 52 may have a layered structure of a Au layer and a Pt layer as described in Japanese Patent Application Laid-open No. 2016-136485. At this time, a layered structure (Pt layer/Au layer) having the Au layer as a lower layer and the Pt layer as an upper layer is preferred. The thickness of the Pt layer in the layered structure is preferred to be 10 nm or more and 100 nm or less, and is, for example, 20 nm. The thickness of the Au layer in the layered structure is preferred to be 10 nm, or more and 100 nm or less, and is, for example, 20 nm. As compared to the case in which the second electrode 52 is formed of only the Au layer, the lifetime can be extended to about 5 times by employing the layered structure of Pt layer/Au layer.

Figure 2A:
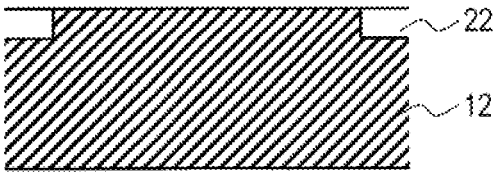
FIG. 2A, FIG. 2B, and FIG. 2C are schematic sectional views for illustrating a method of manufacturing the electron emission device 100 according to an embodiment of the present invention.
Figure 2B:
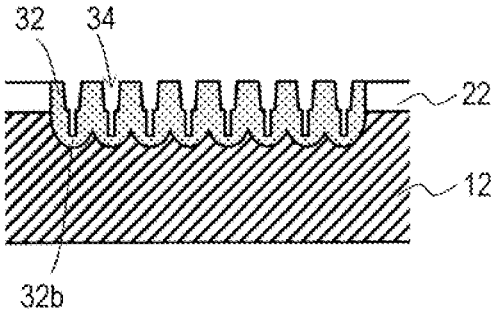
Figure 2C:
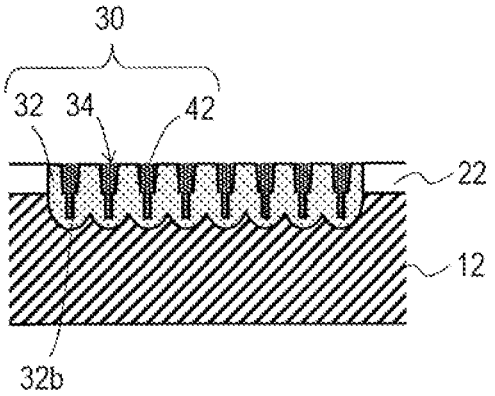

Next, with reference to FIG. 2A to FIG. 2C, the method of manufacturing the electron emission device 100 is described. FIG. 2A to FIG. 2C are schematic sectional views for illustrating the method of manufacturing the electron emission device 100 according to an embodiment of the present invention.

First, as illustrated in FIG. 2A, the aluminum substrate 12 in which the insulating layer 22 is partially formed is prepared. As the aluminum substrate 12, for example, JIS A1050 (thickness: 0.5 mm) can be used. The insulating layer 22 is formed by, for example, performing anodization (alumite treatment) and sealing treatment under a state in which a device forming region on the surface of the aluminum substrate 12 is masked. The insulating layer 22 is formed as follows. For example, anodization is performed with sulfuric acid aqueous solution (15 wt %, 20° C.±1° C.) at a current density of 1 A/dm$^2$ for from 250 seconds to 300 seconds so as to form a porous alumina layer having a thickness of from 2 μm to 4 μm. After that, the porous alumina layer is subjected to sealing treatment with distilled water (pH: 5.5 to 7.5, 90° C.) for about 30 minutes.

Pre-treatment may be performed on the surface of the aluminum substrate 12 as required. For example, microblasting may be performed. Alternatively, after anodization is once performed to form the porous alumina layer, the porous alumina layer may be removed by etching. The pores of the porous alumina layer formed first tend to distribute irregularly (randomly), and hence when the porous alumina layer having regularly-arranged pores is to be formed, it is preferred to remove the porous alumina layer formed first.

Next, as illustrated in FIG. 2B, the surface of the aluminum substrate 12 is anodized to form the porous alumina layer 32. As described later with reference to FIG. 3A to FIG. 3C, etching may be performed after the anodization as required. The anodization and the etching may be alternately repeated through multiple cycles. The pores 34 having various sectional shapes and sixes can be formed by adjusting conditions of the anodization and the etching.

Next, as illustrated in FIG. 2C, silver (Ag) 42 is supported in the pores 34 of the porous alumina layer 32. When Ag nanoparticles are used as Ag, dispersion liquid in which the Ag nanoparticles are dispersed in an organic solvent (for example, toluene) is applied onto the porous alumina layer 32. The Ag nanoparticles in the dispersion liquid may be covered with an organic compound (for example, an alcohol derivative and/or a surfactant). The content of Ag nanoparticles in the dispersion liquid is preferred to be, for example, 0.1 mass % or more and 10 mass % or less, and is, for example, 2 mass %. There is no particular limitation on a method of applying the dispersion liquid. For example, spin coating or spray coating can be employed.

Figure 3A:
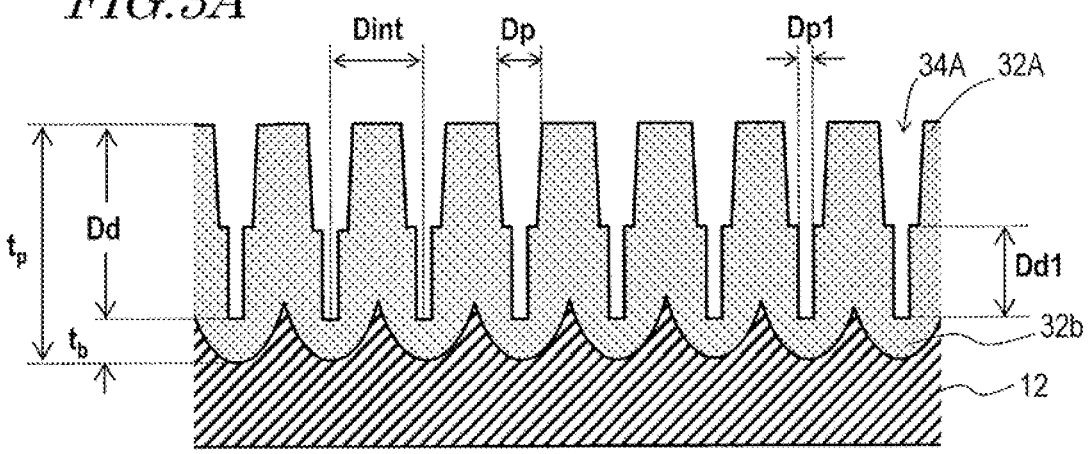
FIG. 3A, FIG. 3B, and FIG. 3C are schematic sectional views for illustrating examples of a porous alumina layer to be used for a semi-conductive layer of the electron emission device 100.
Figure 3B:
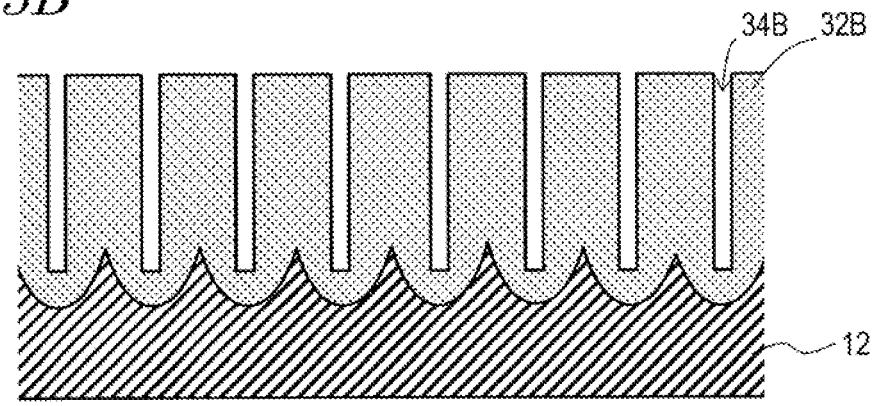
Figure 3C:
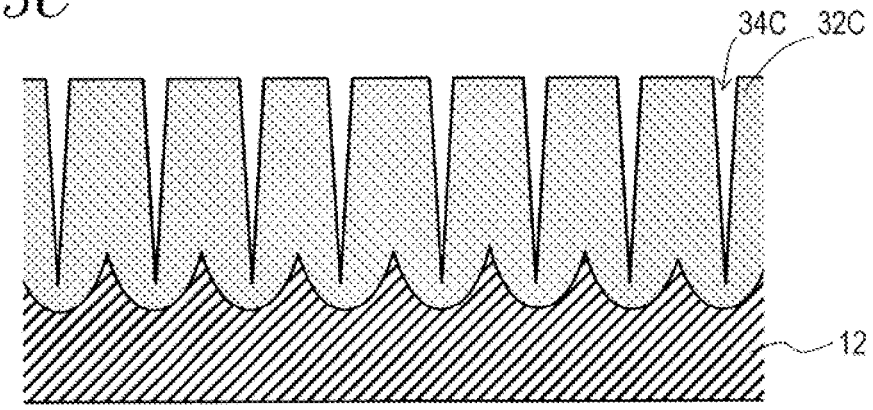

Next, with reference to FIG. 3A to FIG. 3C, the structure of the porous alumina layer 32 of the electron emission device 100 is described. The porous alumina layer 32 may be, for example, any one of porous alumina layers 32A, 32B, and 32C illustrated in FIG. 3A, FIG. 3B, and FIG. 3C, respectively. Further, the porous alumina layer 32 is not limited to the porous alumina layers 32A, 32B, and 32C, and may be variously modified as described below.

The porous alumina layer is formed by, for example, anodizing the surface of the aluminum substrate in an acid electrolyte (part not anodized becomes the first electrode 12). The electrolyte used in the step of forming the porous alumina layer is, for example, an aqueous solution containing an acid selected from the group consisting of oxalic acid, tartaric acid, phosphoric acid, chromic acid, citric acid, and malic acid. The opening diameter Dp, an adjoining distance Dint, a depth Dd of the pore, a thickness tp of the porous alumina layer, and a thickness tb of the barrier layer can be controlled by adjusting anodization conditions (for example, an electrolyte type and an applied voltage). The porous alumina layer obtained by anodization has, for example, columnar pores 34B as with the porous alumina layer 32B illustrated in FIG. 3B.

When the porous alumina layer is brought into contact with an alumina etchant after the anodization to subject the porous alumina layer to etching by a predetermined amount, the diameter of the pore can be increased. When wet etching is employed in this case, a pore wall and the barrier layer can be etched in a substantially isotropic manner. The etching amount (that is, the opening diameter Dp, the adjoining distance Dint, the depth Dd of the pore, the thickness tb of the barrier layer, and the like) can be controlled by adjusting the type and concentration of the etching solution and the etching time. As the etching solution, for example, an aqueous solution of phosphoric acid, an aqueous solution of an organic acid such as formic acid, acetic acid, or citric acid, or a chromic and phosphoric acid mixture aqueous solution can be used. The porous alumina layer obtained by performing etching only once after the anodization has the columnar pores 34B as with the porous alumina layer 32B of FIG. 3B, but the opening diameter Dp of the pore 34B and the thickness tb of a barrier layer 32*b* change depending on etching.

For example, the anodization is performed with oxalic acid aqueous solution (0.05 M, 5° C.) at a formation voltage of 80 V for about 25 minutes, and then etching is performed with phosphoric acid aqueous solution (0.1 M, 25° C.) for 20 minutes. In this manner, the porous alumina layer 32B having the depth Dd of about 2,000 nm, the opening diameter Dp of 100 nm, the adjoining distance Dint of 200 nm, and the thickness tb of the barrier layer of about 30 nm can be obtained.

Further, as another example, for example, the anodization is performed with oxalic acid aqueous solution (0.05 M, 5° C.) at a formation voltage of 80 V for about 10 minutes, and then etching is performed with phosphoric acid aqueous solution (0.1 M, 25° C.) for 20 minutes. In this manner, the porous alumina layer 32B having the depth Dd of about 700 nm, the opening diameter Dp of 100 nm, the adjoining distance Dint of 200 nm, and the thickness tb of the barrier layer of 50 nm can be obtained.

When anodization is further performed after the etching step, the pores can be grown in the depth direction, and the thickness of the porous alumina layer can be increased. The pore starts to grow from a bottom portion of the pore that has been already formed, and hence the pore has a step-like side surface. As a result, as with pores 34A illustrated in FIG. 3A, the pore 34A having a step-like side surface is obtained. The pore 34A has two pore parts having different pore diameters in the depth direction, and the pore diameter is smaller as the pore part is located at a deeper position. For example, as illustrated in FIG. 3A, the pore part (having a depth Dd1 and a pore diameter Dp1) located at a deeper position has a pore diameter Dp1 that is smaller than the opening diameter Dp. The pore 34A having the step-like side surface can capture the Ag nanoparticles at a level-difference part of the step, and hence the pore 34A may have an advantage in that a large number of Ag nanoparticles can be supported in the pore 34A. For example, among the plurality of pores 34, the pore having an opening diameter of about 100 nm or more and about 3 μm or less is preferred to have a pore part having a pore diameter of 50 nm or more and 500 nm or less at a deeper position.

The porous alumina layer 32A may be formed as follows, for example. The anodization is performed with oxalic acid aqueous solution (0.05 M, 5° C.) at a formation voltage of 80 V for about 10 minutes, and then etching is performed with phosphoric acid aqueous solution (0.1 M, 25° C.) for 20 minutes. After that, the anodization is performed again with oxalic acid aqueous solution (0.05 M, 5° C.) at a formation voltage of 80 V for about 20 minutes. In this manner, the porous alumina layer 32A having the depth Dd of about 1,500 nm, the opening diameter Dp of 100 ma, the adjoining distance Dint of 200 nm, and the thickness tb of the barrier layer of 50 nm can be obtained. In this case, the pore 34A has two pore parts having different pore diameters in the depth direction, and has the pore part having the depth Dd1 of 500 nm and the pore diameter Dp1 of about 20 nm at a deeper position.

Further after that, as required, the porous alumina layer may be brought into contact with an alumina etchant to further subject the porous alumina layer to etching so that the pore diameter is further increased. As the etching solution, also in this case, it is preferred to use the above-mentioned etching solution.

When the anodization step and the etching step are repeated, for example, pores each having at least two pore parts having different pore diameters in the depth direction and each having a smaller pore diameter as the pore part is located at a deeper, position can be formed. Further, as in the porous alumina layer 32C illustrated in FIG. 3C, pores 34C each having an inclined side surface (it seems like an inclined surface when the level difference of the step is sufficiently small) can be formed. The entire shape of the pore 34C is substantially a cone (which is upside down). The applicant of the subject application has established a technology of mass-producing an antireflection film having a moth-eye structure with the use of the porous alumina layer having conical pores as a mold.

As described above, the porous alumina layer 32 may be any one of the porous alumina layers 32A, 32B, and 32C illustrated in FIG. 3A, FIG. 3B, and FIG. 3C, respectively, but the porous alumina layer 32 is not limited to those layers and may be variously modified. Regardless of the shape of the porous alumina layer 32, the thickness tp of the porous alumina layer 32 is, for example, about 10 nm or more and about 5 μm or less. When the thickness tp is smaller than 10 nm, sufficient silver (for example, Ag nanoparticles) cannot be supported, and desired electron emission efficiency may not be obtained. There is no particular upper limitation on the thickness tp of the porous alumina layer 32, but the electron emission efficiency tends to be saturated even when the thickness is increased and hence the thickness is not required to be larger than 5 μm from the viewpoint of manufacturing efficiency.

The depth Dd of the plurality of pores 34 of the porous alumina layer 32 is, for example, 10 nm or more and 5 μm or less. The depth Dd of the plurality of pores 34 may be, for example, 50 nm or more and 500 nm or less. The depth Dd of the plurality of pores 34 may be set as appropriate depending on the thickness of the porous alumina layer 32.

The thickness tb of the barrier layer 32*b* of the porous alumina layer 32 is preferred to be 1 nm or more and 1 μm or less. The thickness tb of the barrier layer 32*b* is further preferred to be 100 nm or less. The barrier layer 32*b* is a layer forming the bottom portion of the porous alumina layer 32. When the barrier layer 32*b* is thinner than 1 nm, short-circuit may occur when a voltage is applied, and in contrast, when the barrier layer 32*b* is thicker than 1 μm, a sufficient voltage may not be applied to the semi-conductive layer 30. The thickness tb of the barrier layer 32*b* of the porous alumina layer 32 generally depends on the anodization conditions, as well as the adjoining distance Dint and the opening diameter (two-dimensional size) Dp of the pores 34.

Now, while representing experimental examples, the electron emission device 100 according to an embodiment of the present invention is described in further detail.

Figure 4A:
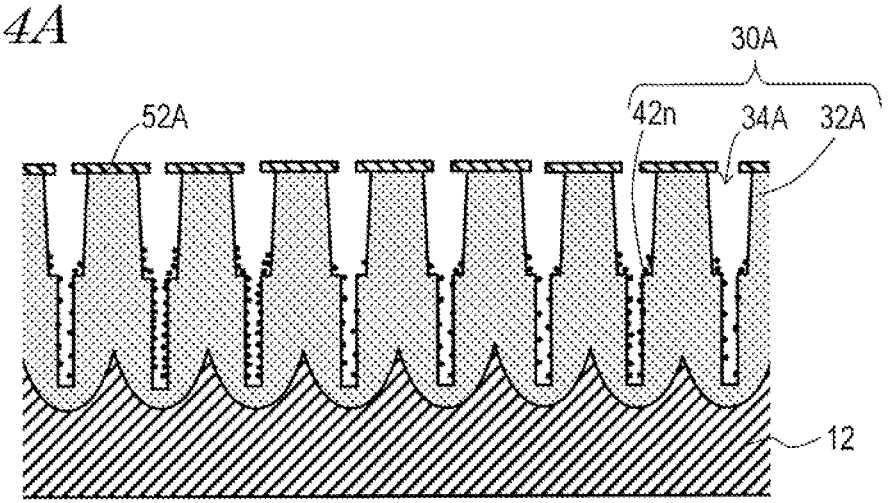
FIG. 4A, FIG. 4B, and FIG. 4C are schematic sectional views for illustrating a difference of a state of silver nanoparticles in a semi-conductive layer 30A in the electron emission device according to an embodiment of the present invention.
Figure 4B:
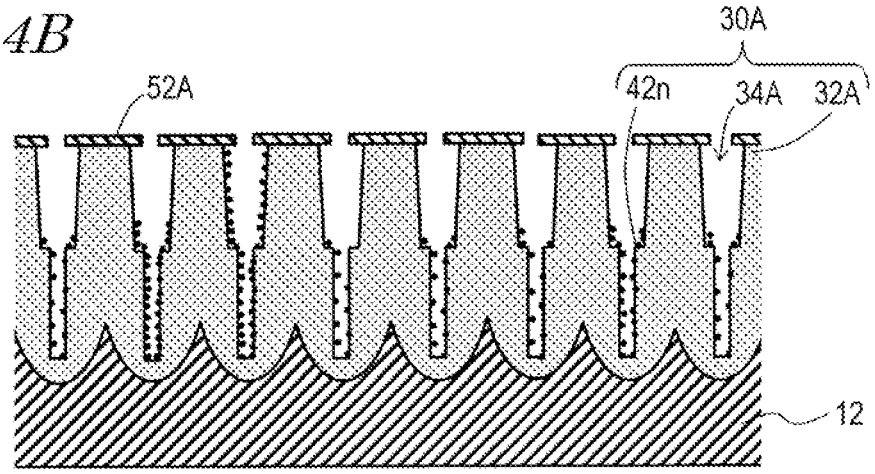
Figure 4C:
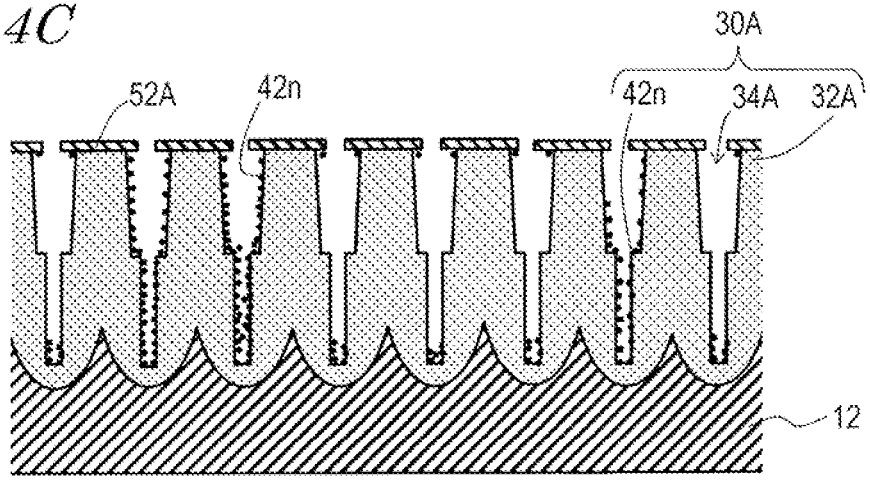

FIG. 4A to FIG. 4C are schematic sectional views for illustrating a difference of a state of the silver nanoparticles in a semi-conductive layer 30A in an electron emission device according to an embodiment of the present invention. FIG. 4A is an illustration of a state immediately after formation of the semi-conductive layer 30A, FIG. 4B is an illustration of a state before driving after forming treatment, and FIG. 4C is an illustration of a structure during stable operation. All of them are schematic illustrations that are based on results of observing cross sections of a test device with a scanning transmission electron microscope (hereinafter referred to as "STEM").

The semi-conductive layer 30A can be obtained by, for example, causing the porous alumina layer 32A formed as described above to support Ag nanoparticles 42*n*.

As the Ag nanoparticles, for example, an Ag-nanoparticle dispersion liquid obtained by dispersing Ag nanoparticles covered with an alcohol derivative in an organic solvent (average particle diameter of Ag nanoparticles covered with alcohol derivative: 6 nm, dispersion solvent: toluene, Ag concentration: 1.3 mass %) can be used. For example, on the porous alumina layer 32A formed in a region of (about 5 mm)×(about 5 mm), 200 microliters (μL) of Ag-nanoparticle dispersion liquid described above are dropped, and spin coating is performed under conditions of, for example, 500 rpm and 5 seconds and thereafter 1,500 rpm and 10 seconds. After that, for example, firing is performed at 150° C. for 1 hour. In order to improve the dispersibility, the Ag nanoparticles are covered with an organic substance having, for example, an alkoxide and/or carboxylic acid and derivatives thereof at the terminal. With the firing step, the above-mentioned organic substance can be removed or reduced.

In the semi-conductive layer 30A immediately after the formation, as illustrated in FIG. 4A, a large number of Ag nanoparticles 42*n* are present at lower portions of the pores 34A.

When forming treatment is performed, as illustrated in FIG. 4B, in some of the pores 34A, the Ag nanoparticles 42*n* are arrayed in the depth direction of the pores 34A, and are distributed up to the vicinity of the openings of the pores 34A. Electrons are emitted from the pore 34A in which the Ag nanoparticles 42*n* are distributed up to the vicinity of the opening (third pore 34A from the left in FIG. 48). The forming treatment refers to energization treatment to be performed to stabilize electron emission. The forming treatment is performed as follows although it depends on the structure of the semi-conductive layer 30A. A voltage to be applied to the electron emission device 100 (for example, a drive voltage Vd illustrated in FIG. 7) is set to, for example, a rectangular wave having a frequency of 2 kHz and a duty ratio of 0.5, and this voltage is boosted up to about 20 V at a velocity of 0.1 V/sec. The voltage to be applied to the electron emission device 100 is herein represented by a potential of the second electrode 52 with reference to a potential of the first electrode 12. When the voltage to be applied to the electron emission device 100 is 20 V, for example, the potentials of the first electrode 12 and the second electrode 52 are, for example, −20 V and 0 V, respectively. The present invention is not limited to this example, and the potential of the first electrode 12 may be the ground potential, and the potential of the second electrode 52 may have a positive value.

While the electrons are stably emitted, as illustrated in FIG. 4C, it is considered that the pores 34A in which the Ag nanoparticles 42*n* are distributed up to the vicinity of the openings are sequentially formed.

After that, there occurs a phenomenon that the porous alumina layer 32 is locally broken. It is considered that this phenomenon occurs due to heat generated with electron emission.

Figure 5A:
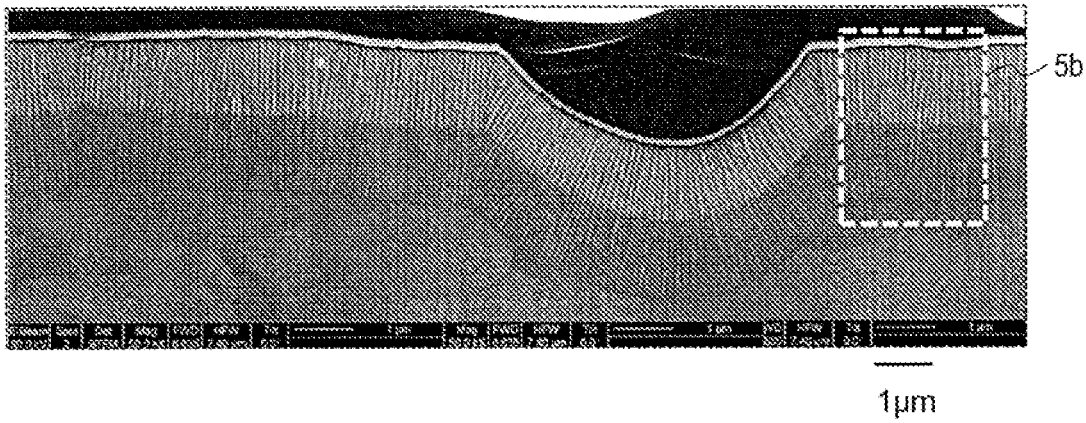
FIG. 5A and FIG. 5B are diagrams for showing sectional STEM images of the semi-conductive layer including the silver nanoparticles.
Figure 5B:
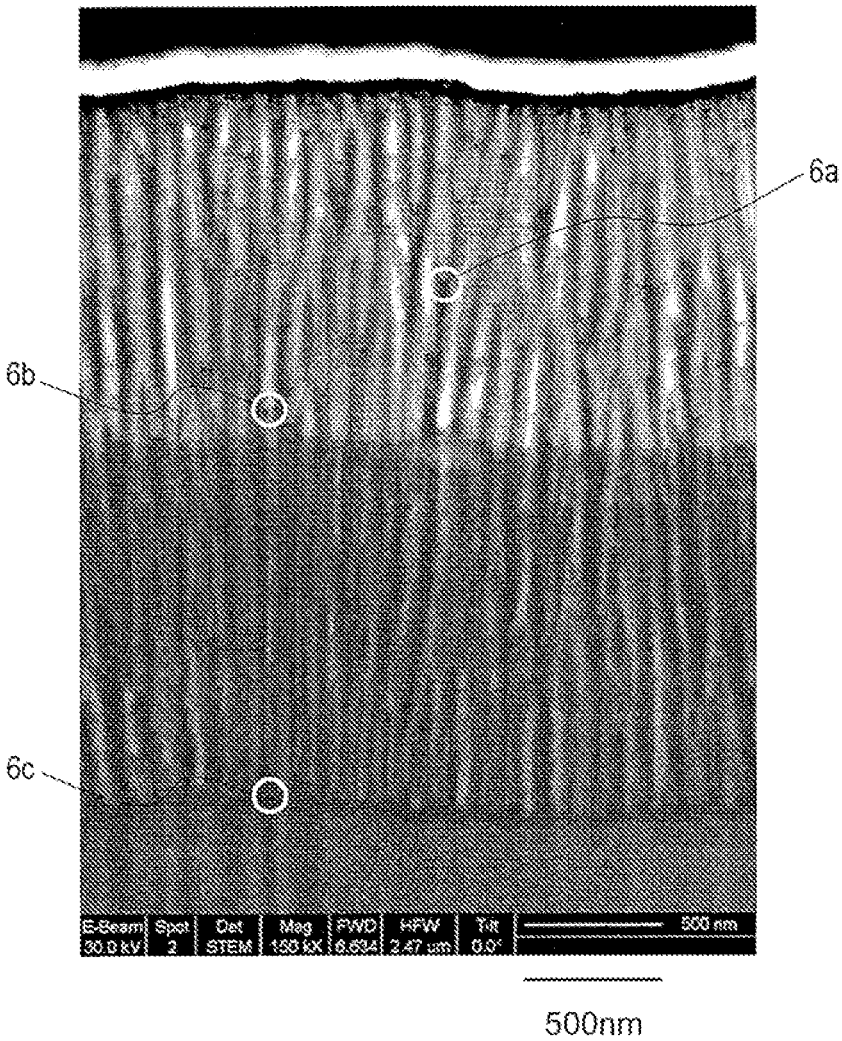
Figure 6A:
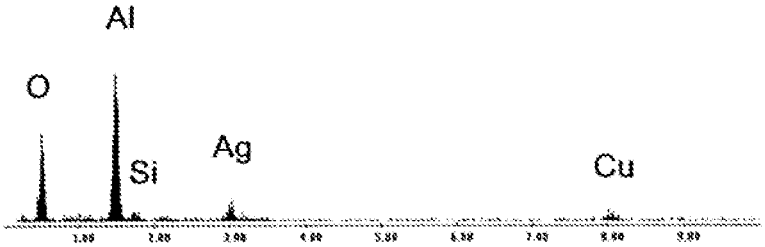
FIG. 6A, FIG. 6B, and FIG. 6C are graphs for showing EDX analysis results in the cross section of the semi-conductive layer (in open circles 6*a*, 6*b*, and 6*c* in FIG. 5B).
Figure 6B:
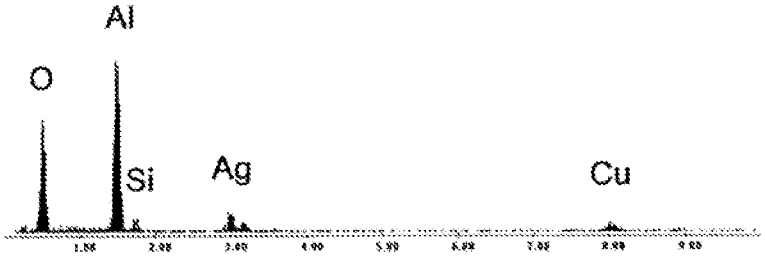
Figure 6C:
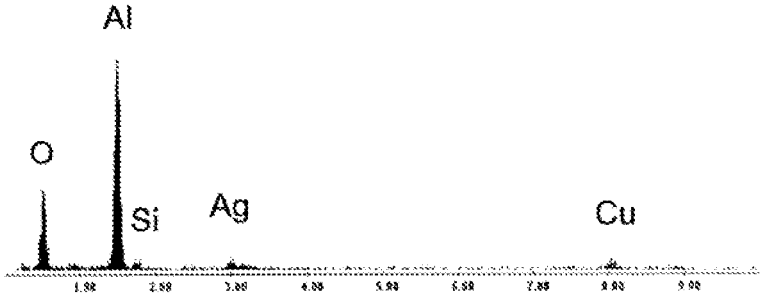

FIG. 5A and FIG. 5B are examples of sectional STEM images of the semi-conductive layer (not energized) of the test device. FIG. 5B is for showing an enlarged image of a region surrounded by a broken line 5*b* in FIG. 5A. Further, results obtained by analyzing insides of regions indicated by open circles 6*a*, 6*b*, and 6*c* in FIG. 5B (vicinity of black dots considered to be Ag nanoparticles) with energy dispersive X-ray spectrometry (hereinafter referred to as "EDX") are shown in FIG. 6A, FIG. 6B, and FIG. 6C. As the STEM, DB-Strata 237 manufactured by FEI Company Japan Ltd. was used, and for the EDX, Genesis 2000 manufactured by EDAX Japan K.K. was used. The same holds true in the following unless particularly noted.

As is understood from FIG. 5A, the pores extend in the direction normal to the surface. Further, in FIG. 6A, FIG. 6B, and FIG. 6C, the presence of Ag is confirmed, and hence the black dots in FIG. 5B are considered to be the Ag nanoparticles. Thus, the Ag nanoparticles are supported in the pores in a random and scattered manner. The semi-conductive layer shown in FIG. 5A and FIG. 5B includes the porous alumina layer 32A. That is, the pore 34A of the porous alumina layer 32A has a step-like side surface, and has two pore parts having different pore diameters in the depth direction. In FIG. 5A and FIG. 5B, it is considered that a darker image is obtained for the pore part located at a deeper position.

Figure 7:
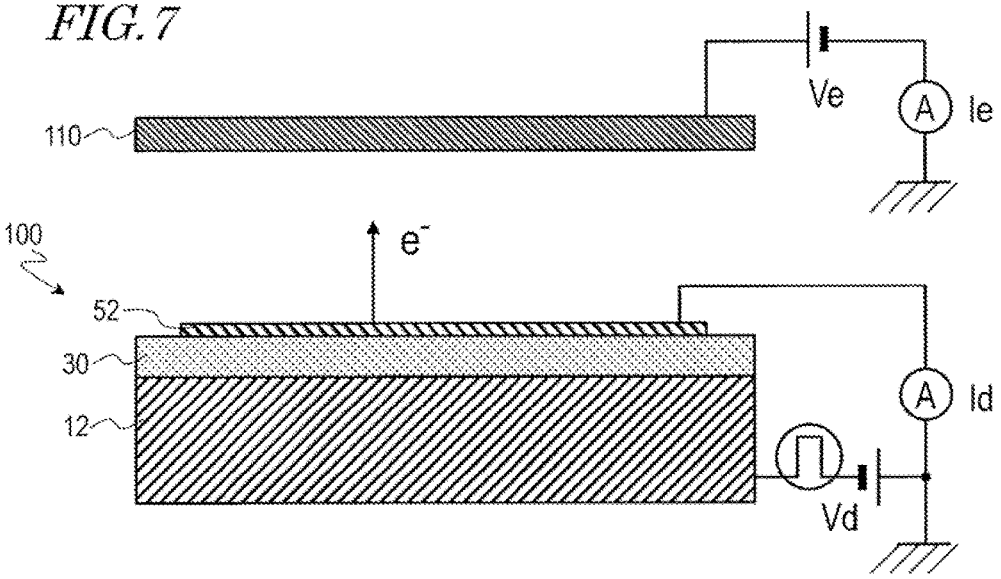
FIG. 7 is a diagram for schematically illustrating a system for measuring electron emission characteristics of the electron emission device 100.
Figure 8:
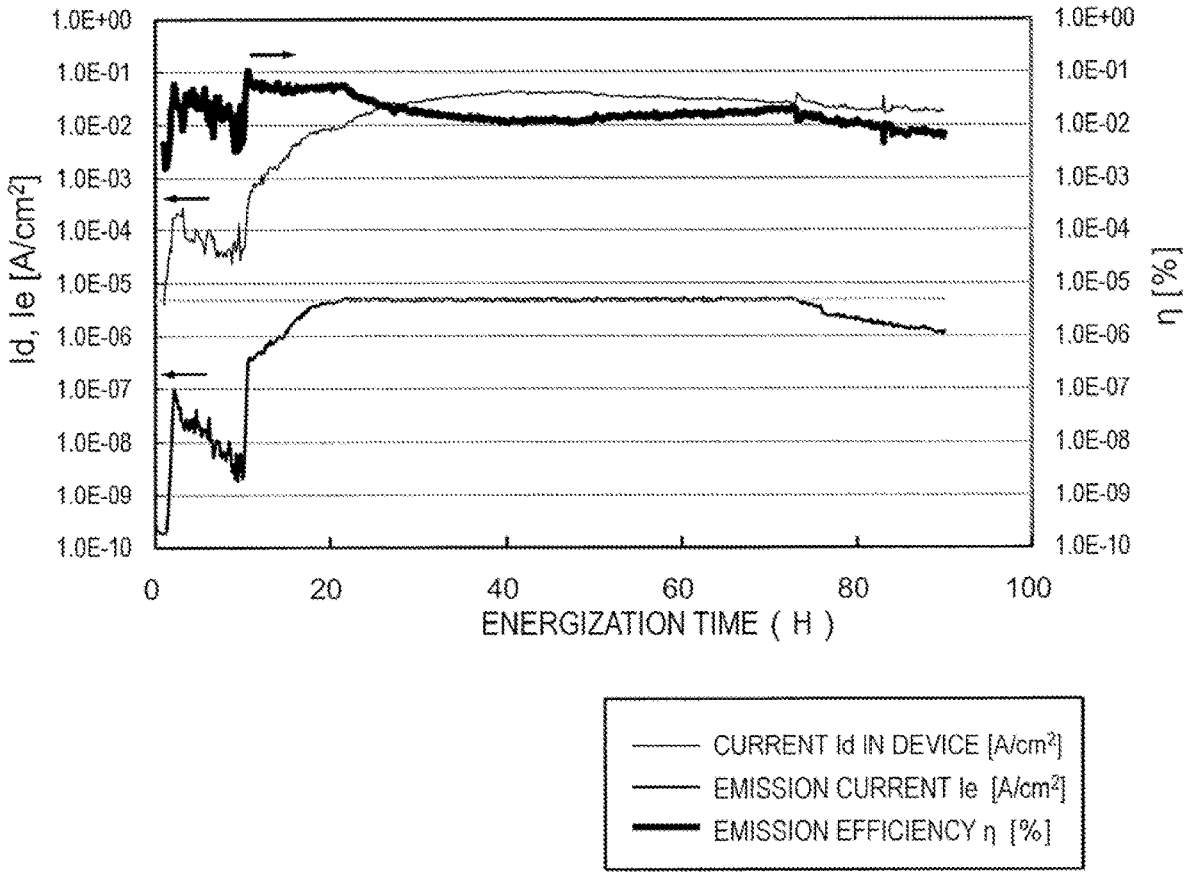
FIG. 8 is a graph for showing energization test results of an electron emission device according to Example of the present invention.

With reference to FIG. 7 and FIG. 8, results of evaluation of the lifetime of an electron emission device according to Example of the present invention are described. FIG. 7 is a schematic illustration of a system for measuring electron emission characteristics of the electron emission device 100, and FIG. 8 is a graph for showing energization test results (electron emission characteristics) of the electron emission device 100 including the semi-conductive layer shown in FIG. 5A and FIG. 5B.

As illustrated in FIG. 7, a counter electrode 110 was located on the second electrode 52 side of the electron emission device 100 so as to be opposed to the second electrode 52, and a current caused in the counter electrode 110 by electrons emitted from the electron emission device 100 was measured. The drive voltage to be applied to the electron emission device 100 is represented by Vd, a current in the device is represented by Id, a voltage to be applied to the counter electrode 110 (also referred to as "collection voltage") is represented by Ve, and an emission current caused in the counter electrode 110 is represented by Ie. A distance between the counter electrode 110 and the second electrode 52 was set to 0.5 mm, and the voltage Ve to be applied to the counter electrode 110 was set to 600 V. In this case, as illustrated in FIG. 7, the potential of the second electrode 52 was set to the ground potential, and a negative voltage was applied to the first electrode 12. The present invention is not limited to this example, and in order to cause the second electrode 52 to emit electrons, the potential of the second electrode 52 is only required to be higher than the potential of the first electrode 12.

In FIG. 8, the current Id in the device, the emission current Ie, and emission efficiency $\eta$ are plotted with respect to an energization time. The emission efficiency $\eta$ is given by $\eta$=Ie/Id. The emission efficiency $\eta$ is required to be 0.01% or more, and is preferred to be 0.05% or more.

The configuration of the manufactured electron emission device 100 is shown below.

First electrode 12: part of JIS A1050 (having thickness of 0.5 mm) excluding part anodized Porous alumina layer (32A): opening diameter Dp of about 100 nm, depth Dd of about 2,200 nm, adjoining distance Dint of 200 nm, thickness tp of porous alumina layer of 2,200 nm, and thickness tb of barrier layer of about 50 nm Deeper pore part: pore diameter Dp1 of about 20 nm, and depth Dd1 of about 1,500 nm Shallower pore part: pore diameter (opening diameter Dp) of about 100 nm, and depth of about 700 nm Ag nanoparticles 42*n*: average particle diameter of Ag nanoparticles covered with alcohol derivative, which are included in above-mentioned Ag-nanoparticle dispersion liquid, of 6 nm Second, electrode 52: Au layer (having thickness of 40 nm)

Device size (size of second electrode 52); 5 mm×5 mm

The porous alumina layer 32A shown in FIG. 5A and FIG. 5B was formed as follows. Anodization was performed with oxalic acid aqueous solution (0.05 M, 5° C.) at a formation voltage of 80 V for about 27 minutes, and then etching was performed with phosphoric acid aqueous solution (0.1 M, 25° C.) for 20 minutes. After that, anodization was performed again with oxalic acid aqueous solution (0.05 M, 5° C.) at a formation voltage, of 80 V for about 27 minutes.

The energization test of the electron emission device 100 was performed through intermittent drive with an ON time of 16 seconds and an OFF time of 4 seconds after the above-mentioned forming treatment was performed. The drive conditions are as follows. The drive voltage Vd (pulse voltage) to be applied between the first electrode 12 and the second electrode 52 was set to a rectangular wave having a frequency of 2 kHz and a duty ratio of 0.5, and the drive voltage Vd was boosted at a velocity of 0.1 V/sec until the emission current Ie reached a defined value (in this case, 4.8 $\mu A/cm^2$) or more. After that, feed-back control was performed to adjust the drive voltage Vd so that the emission current Ie monitored by the counter electrode 110 was constant. The drive environment was 25° C., and a relative humidity RH was from 30% to 40%.

As is understood from FIG. 8, the lifetime of the electron emission device 100 according to Example was about 50 hours. In this case, the lifetime of the electron emission device refers to a time in which the emission current Ie was able to maintain a constant value. In this case, the length of time in which the emission current Ie was able to maintain 4.8 $\mu A/cm^2$ was examined as the lifetime of the electron emission device, on the assumption that the electron emission device is used as a charging device of a medium-speed copier. The value (4.8 $\mu A/cm^2$) is a value estimated as an emission current required for charging a photosensitive drum, of the medium-speed copier having a rotational speed of 285 mm/sec. As is understood from FIG. 8, the emission current Ie of the electron emission device 100 maintained 4.8 $\mu A/cm^2$ (value indicated by the dotted line in FIG. 8) for about 50 hours.

From the investigations so far, it has been found that the lifetime can be increased to about 5 times (about 160 hours) by forming a second electrode 74 (single Au layer having a thickness of 40 nm) of an electron emission device 200 according to Comparative Example to be referred to below with reference to FIG. 9 into a layered structure of Pt layer/Au layer (20 nm/20 nm) (for example, see Japanese Patent Application Laid-open No. 2016-136485). Therefore, when the second electrode 52 of the manufactured electron emission device 100 is replaced with the above-mentioned layered structure, the lifetime may be extended up to about 250 hours.

Figure 9:
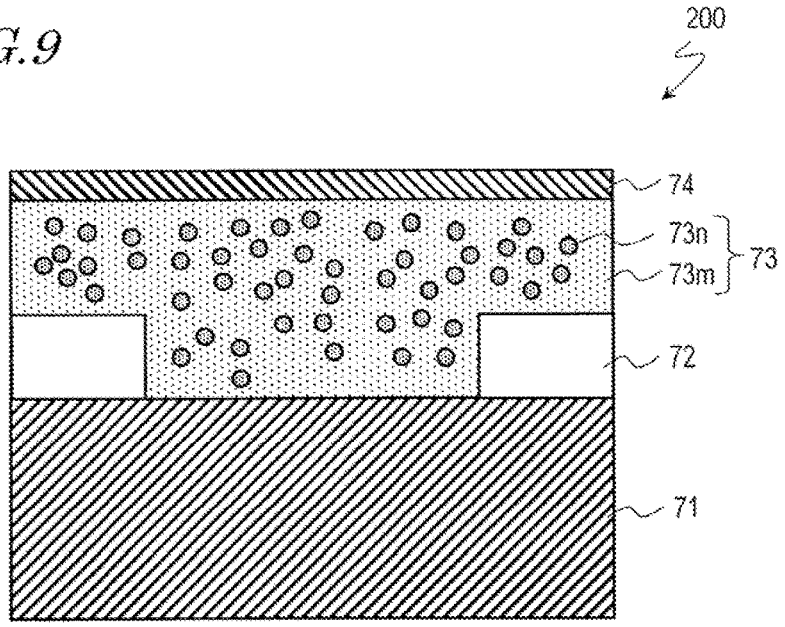
FIG. 9 is a schematic sectional view for illustrating an electron emission device 200 according to Comparative Example.
Figure 10:
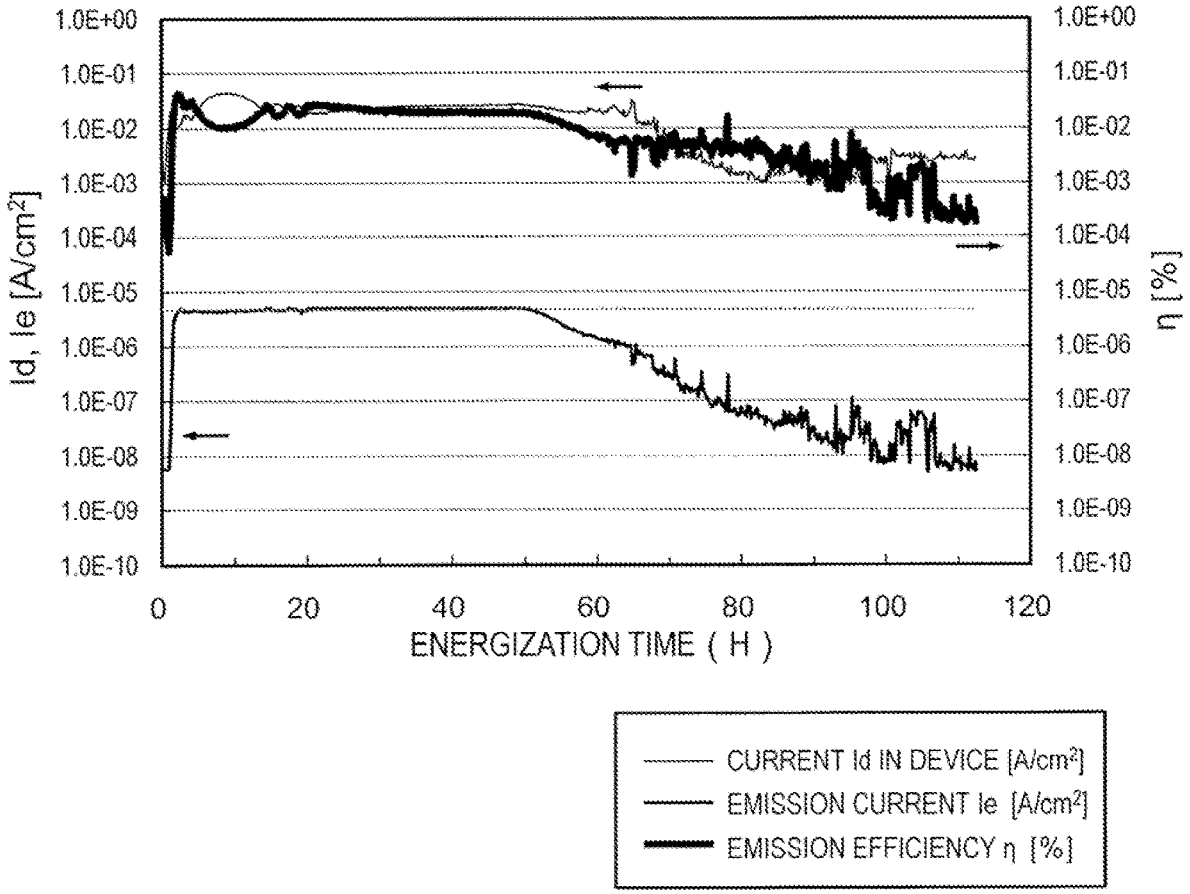
FIG. 10 is a graph for showing energization test results of the electron emission device according to Comparative Example.

For comparison, the electron emission device 200 for reference illustrated in FIG. 9 was manufactured, and similar evaluation was performed. FIG. 10 is a graph for showing the energization test results (electron emission characteristics) of the electron emission device 200 according to Comparative Example. In FIG. 10, the current Id in the device, the emission current Ie, and the emission efficiency $\eta$ are plotted with respect to the energization time.

The configuration of the manufactured electron emission device is shown below.

First electrode 71: JIS A1050 (thickness: 0.5 mm)

Insulating layer 72: anodized alumina layer (porous alumina layer subjected to sealing treatment) having thickness of 4 μm Semi-conductive layer 73: thickness of from 1 μm to 2 μm Insulator 73*m*: silicone resin Ag nanoparticles 73*n*: average particle diameter of Ag nanoparticles covered with alcohol, derivative, which are included in above-mentioned Ag-nanoparticle dispersion liquid, of 6 nm, and 1.5 mass % with respect to the silicone resin Second electrode 74: Au layer (having thickness of 40 nm)

Device size (size of second electrode 74); 5 mm×5 mm

The insulating layer 72 was formed by a method similar to that of the insulating layer 22 of the electron emission device 100 described with reference to FIG. 2A.

As is understood from FIG. 10, the lifetime of the above-mentioned electron emission device 200 manufactured as Comparative Example was about 50 hours. The lifetime of the electron emission device 200 according to Comparative Example was evaluated in a way similar to that of the electron emission device 100 according to Example.

Figure 11:
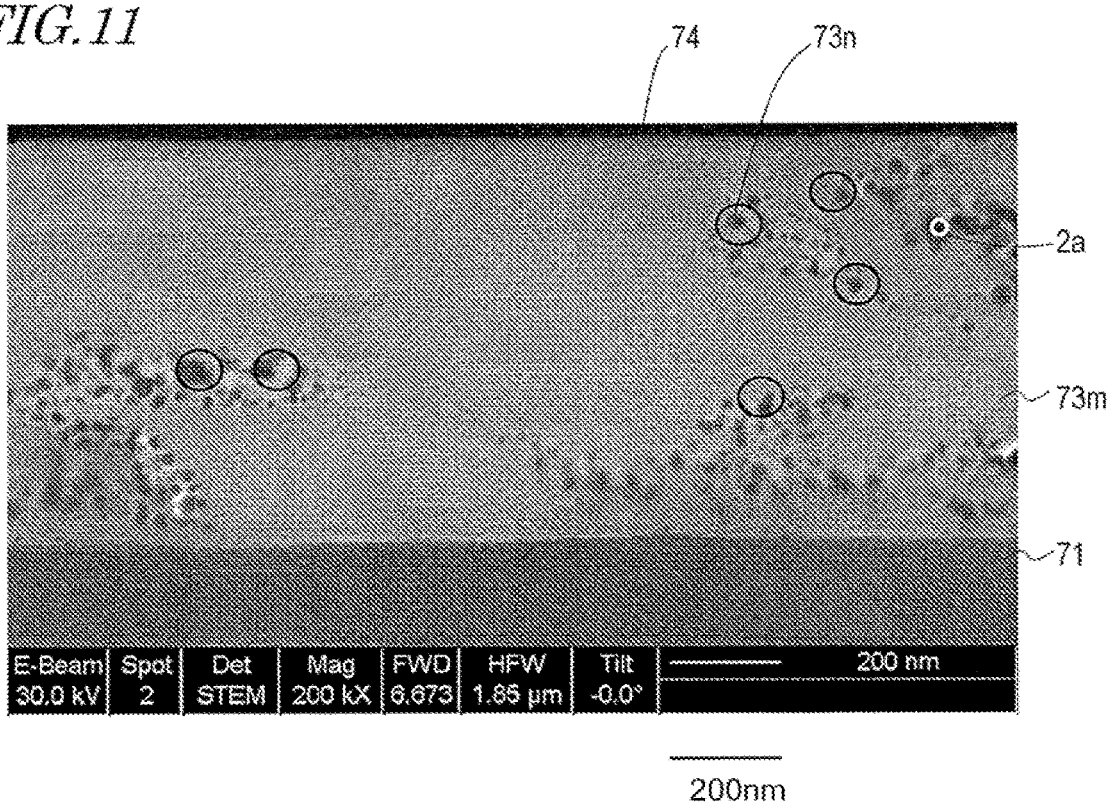
FIG. 11 is a diagram for showing a sectional STEM image of a semi-conductive layer including silver nanoparticles of the electron emission device according to Comparative Example.
Figure 12:
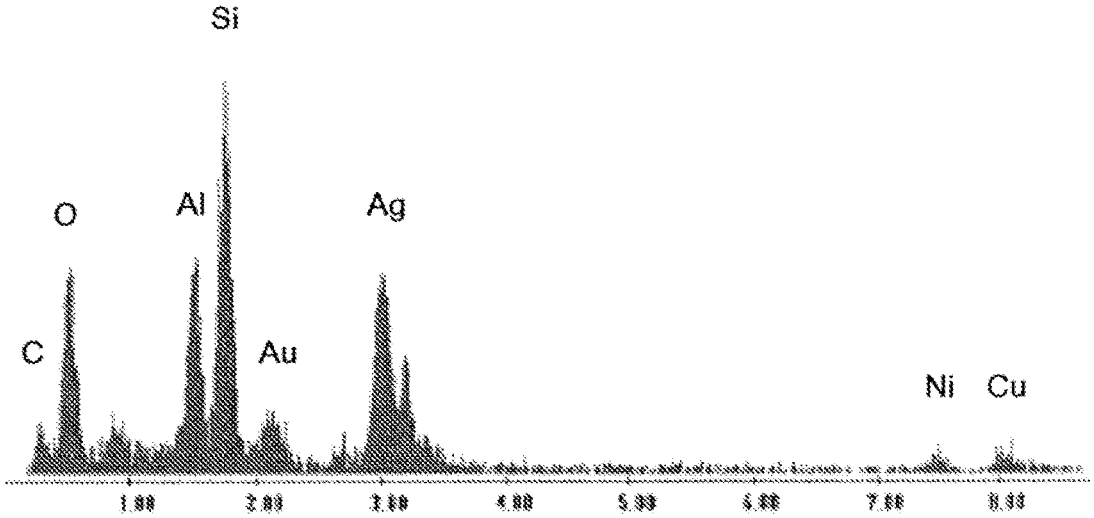
FIG. 12 is a graph for showing EDX analysis results in the cross section of the semi-conductive layer of the electron emission device according to Comparative Example (region indicated by an open circle 2*a* in FIG. 11).

FIG. 11 is an example of a sectional STEM image of the electron emission device 200 (not energized) according to Comparative Example, and FIG. 12 is a graph for showing results of analysis of the cross section of FIG. 11 (region indicated by an open circle 2*a* in FIG. 11) with the EDX.

As is understood, from FIG. 11, the Ag nanoparticles are present in, for example, regions indicated by circles in FIG. 11. In the silicone resin, there are formed a plurality of portions in which the Ag nanoparticles are aggregated (for example, in the open circle 2*a* in FIG. 11). The portions in which the Ag nanoparticles are aggregated are unevenly distributed in the silicone resin.

It is considered that there is a relationship between the distribution state of the Ag nanoparticles (including migration when an electric field is applied) and the electron emission characteristics and/or the lifetime of the device, but specific correlation is not found yet. However, in the electron emission device according to an embodiment of the present invention, the Ag nanoparticles are supported in the pores of the porous alumina layer, and hence the distribution state of the Ag nanoparticles can be controlled by controlling the opening diameter of the pores, the depth of the pores, the adjoining distance of the pores, and the like. Therefore, the characteristic improvement and/or the lifetime extension of the electron emission device may be achieved.

Next, samples No. 1 to No. 3 of three types of electron emission devices shown in Table 1 below were evaluated.

As exemplified here, when the first electrode is formed with the use of an aluminum substrate (having a thickness of 0.2 mm or more) with a relatively high rigidity, which has an aluminum purity of 99.00 mass % or more and less than 99.99 mass %, the aluminum substrate can be used as a support substrate, and hence the electron emission device can be manufactured efficiently.

The samples No. 1 to No. 3 differ from each other in composition (for example, aluminum content) of the aluminum substrate 12 used for forming the first electrode 12. The configuration of the sample No. 1 (thickness: 0.5 mm) and the method of manufacturing the same are basically the same as those of the electron emission device 100 described with reference to FIG. 7 and FIG. 8. In this case, however, a step of dropping 200 microliters (μL) of Ag-nanoparticle dispersion liquid described above on the porous alumina layer 32A (region of (about 5 mm)×(about 5 mm)), and then a step of performing spin coating under conditions of 500 rpm and 5 seconds and thereafter 1,500 rpm and 10 seconds were alternately repeated three times. After that, the sample No. 1 was heated at 150° C. for 1 hour. The samples No. 2 (thickness: 0.5 mm) and No. 3 (thickness: 0.2 mm) are the same as the sample No. 1 except for the composition of the aluminum substrate 12.

In Table 1, main components of the composition of the aluminum substrate forming the first electrode 12 of the samples No. 1 to No. 3 are shown.

The sample No. 1 was manufactured with the use of JIS A1050 as the aluminum substrate 12. JIS A1050 has the following composition (mass %).

Si: 0.25% or less, Fe: 0.40% or less, Cu: 0.05% or less, Mn: 0.05% or less, Mg: 0.05% or less, Zn: 0.05% or less, V: 0.05% or less, Ti: 0.03% or less, others: individually 0.03% or less, Al: 99.50% or more.

The sample No. 2 was manufactured with the use of JIS A1100 as the aluminum substrate 12. JIS A1100 has the following composition (mass %).

Si+Fe: 0.95% or less, Cu: 0.05% to 0.20%, Mn; 0.05% or less, Zn: 0.10% or less, others: individually 0.05% or less and entirely 0.15% or less, Al: 99.00% or more.

The sample No. 3 was manufactured with the use of an aluminum base material containing aluminum of 99.98 mass % or more as the aluminum substrate 12. The aluminum substrate 12 of the sample No. 3 has the following composition (mass %).

Si: 0.05% or less, Fe: 0.03% or less, Cu: 0.05% or less, Al: 99.98% or more.

TABLE 1

| Sample | Composition (mass %) | | | | | | | |
|---|---|---|---|---|---|---|---|---|
| | Si | Fe | Cu | Mn | Mg | Zn | Ti | Al |
| No. 1 | ≤0.25 | ≤0.40 | ≤0.05 | ≤0.05 | ≤0.05 | ≤0.05 | ≤0.03 | ≥99.50 |
| No. 2 | Si + Fe: ≤0.95 | | 0.05 to 0.20 | ≤0.05 | — | ≤0.10 | — | ≥99.00 |
| No. 3 | ≤0.05 | ≤0.03 | ≤0.05 | — | — | — | — | ≥99.98 |

The energization test of the samples No. 1. to No. 3 was performed basically similarly to the energization test described with reference to FIG. 8. In this case, however, for the sake of simplification, the feed-back control of the drive voltage Vd was not performed. Specifically, after the above-mentioned forming treatment was performed, the drive voltage Vd (rectangular wave having a frequency of 2 kHz and a duty ratio of 0.5) was boosted up to 26 V at a velocity of 0.05 V for each cycle, and then was maintained at 26 V. In this case, one cycle refers to the intermittent drive with the ON time of 16 seconds and the OFF time of 4 seconds. The drive environment was from 20° C. to 25° C., and the relative humidity RH was from 30% to 40%.

In all of the samples No. 1 to No. 3, the emission current Ie gradually increased when the drive voltage Vd was around 10 V or more. It was determined that the sample was driven as the electron emission device by confirming the increase of the emission current Ie along with the increase of the drive voltage Vd. As described above, it was confirmed that all of the samples No. 1 to No. 3 were able to be driven as the electron emission device.

In Table 2, results of obtaining an average value of the emission current Ie are shown for each sample. In Table 2, "Δ" represents that the average value of the emission current Ie was 0.001 μA/cm$^2$ or more and less than 0.01 μA/cm$^2$, "o" represents that the average value of the emission current Ie was 0.01 μA/cm$^2$ or more and less than 0.1 μA/cm$^2$, and "●" represents that the average value of the emission current Ie was 0.1 μA/cm$^2$ or more and less than 4.8 μA/cm$^2$.

TABLE 2

| | Sample | | |
|---|---|---|---|
| | No. 1 | No. 2 | No. 3 |
| Average value of emission current Ie | ○ | ● | Δ |

In the sample No. 2 in which the purity (aluminum content) of the aluminum substrate was lower than that of the sample No. 1, the average value of the emission current Ie was larger than that of the sample No. 1. Meanwhile, in the sample No. 3 in which the purity (aluminum content) of the aluminum substrate was higher than that of the sample No. 1, the average value of the emission current Ie was smaller than that of the sample No. 1. Thus, the average value of the emission current Ie was larger as the purity (aluminum content) of the aluminum substrate was lower.

Note that, however, the drive conditions of the above-mentioned energization test are merely an example, and the value of the emission current Ie may change depending on the drive conditions of the electron emission device. Further, when the electron emission device is driven under a state in which the average value of the emission current Ie (that is, electron emission amount per unit time) is large, the time in which the device can be driven as the electron emission device may be reduced. The "time in which the device can be driven as the electron emission device" herein refers to a time from when the device was confirmed to be driven as the electron emission device to when the value of the emission current Ie was decreased with respect to the same drive voltage Vd, and is used under a definition different from the "lifetime" (time in which the emission current Ie is able to maintain a certain value)" described with reference to FIG. 8, for example.

The value of the emission current and the length of the time in which the device can be driven, which are required for the electron emission device, may change depending on applications (that is, drive conditions). For example, in an application in which a large emission current value is required, it is preferred to use an aluminum base material having a relatively low aluminum purity (99.00 mass % or more and 99.50 mass % or less). Meanwhile, for example, in an application in which long-term drive is emphasized, it is preferred to use an aluminum base material having a relatively high aluminum purity (99.50 mass % or more and 99.98 mass % or less).

What kind of mechanism causes the aluminum purity to affect the characteristics of the electron emission device is not clear at this time point, but as is understood from Table 1, an element included as an impurity in the aluminum substrate used here is an element having a higher standard electrode potential than that of aluminum (so-called "noble" element) except for Mg. Therefore, there is a possibility that an impurity element (for example, iron) that is nobler than aluminum is affecting the characteristics of the electron emission device.

When the inventors of the subject application sampled the electron emission device by the above-mentioned method, the electron emission device was not normally driven in some cases. When the inventors of the subject application investigated various structures and manufacturing methods for the electron emission device, it was found that the electron emission device manufactured in the following method suppressed the occurrence of such problem.

With reference to FIG. 13A to FIG. 13E and FIG. 14A to FIG. 14D, description is given of another method of manufacturing an electron emission device according to an embodiment of the present invention and a structure of an electron emission device 100A manufactured by the method. FIG. 13A to FIG. 13E and FIG. 14A to FIG. 14D are schematic sectional views for illustrating another method of manufacturing an electron emission device according to an embodiment of the present invention. In the following, differences from the manufacturing method described with reference to FIG. 2A to FIG. 2C are mainly described.

Figure 13A:
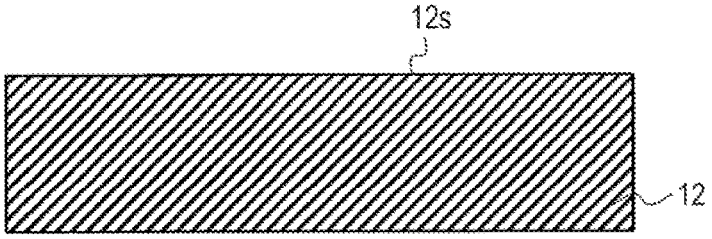
FIG. 13A, FIG. 13B, FIG. 13C, FIG. 13D, and FIG. 13E are schematic sectional views for illustrating another method of manufacturing an electron emission device according to an embodiment of the present invention.

First, as illustrated in FIG. 13A, the aluminum substrate 12 is prepared.

Figure 13B:
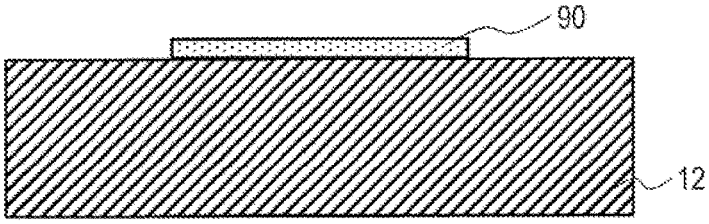

Next, as illustrated in FIG. 13B, a mask (insulating member) 90 for partially covering a surface 12*s* of the aluminum substrate 12 is formed. The mask 90 is formed so as to cover the device forming region of the surface 12*s* of the aluminum substrate 12.

Figure 13C:
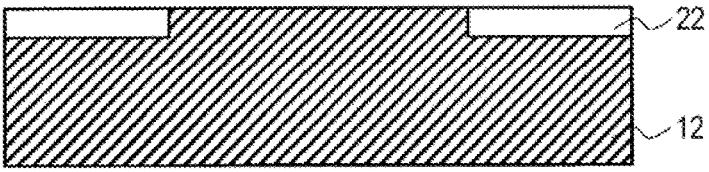

A part of the surface 12*s* of the aluminum substrate 12 not covered with the mask 90 is anodized to form an anodized layer 22 as illustrated in FIG. 13C. The anodized layer 22 forms the insulating layer (also referred to as "interelectrode insulating layer") 22 formed so as to partially cover the surface 12*s* of the aluminum substrate 12. The anodized layer 22 includes, for example, a porous alumina layer. The anodized layer 22 may be further subjected to sealing treatment.

Figure 13D:
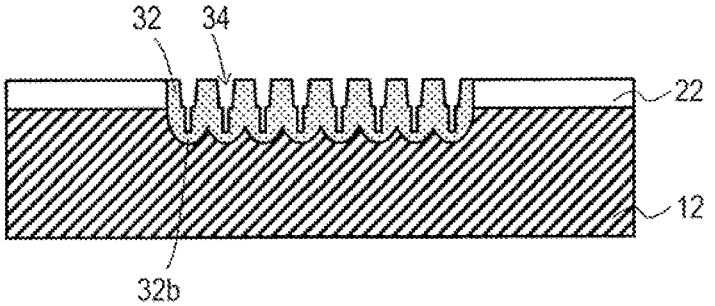

Next, as illustrated in FIG. 13D, the surface 12*s* of the aluminum substrate 12 is anodized to form the porous alumina layer 32 having the plurality of pores 34. The first electrode 12 is formed of an aluminum remaining layer that is a part of the aluminum substrate 12 remaining without being anodized.

Figure 13E:
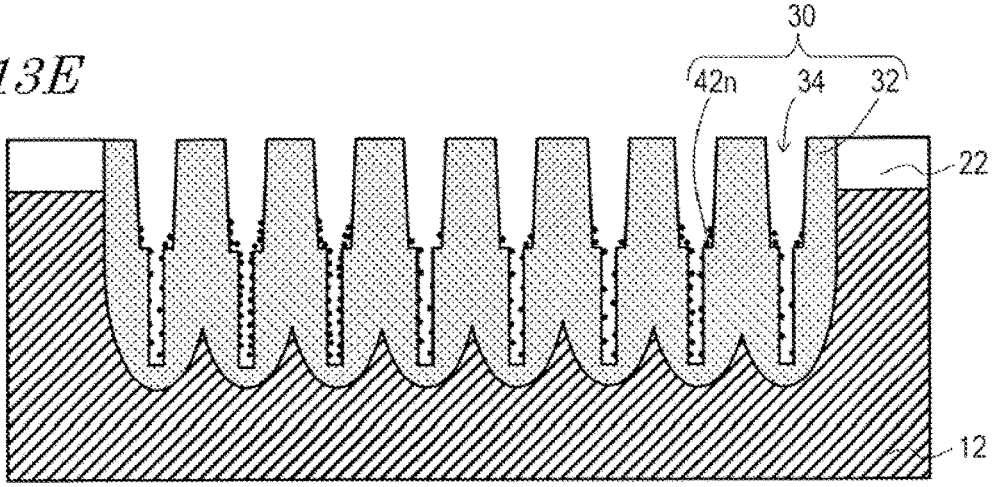

Subsequently, as illustrated in FIG. 13E, the silver nanoparticles 42*n* are applied into the plurality of pores 34 to form the semi-conductive layer 30 including the porous alumina layer 32 and the silver nanoparticles 42*n* supported in the plurality of pores 34.

Figure 14A:
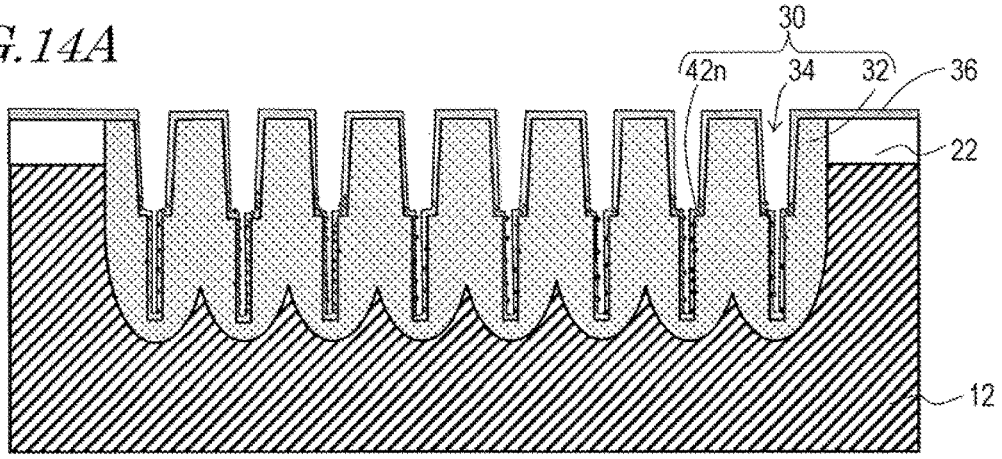
FIG. 14A, FIG. 14B, FIG. 14C, and FIG. 14D are schematic sectional views for illustrating the another of manufacturing an electron emission device according to the embodiment of the present invention.

Next, as illustrated in FIG. 14A, an insulating layer forming solution 36 is applied (for example, by coating or printing) to substantially the entire surface of the aluminum substrate 12. In this case, "substantially the entire surface" at least includes the device forming region of the aluminum substrate 12. When the aluminum substrate 12 includes, for example, a plurality of device forming regions arranged at intervals, the insulating layer forming solution 36 may be applied to at least each of the device forming regions. The device forming region is defined by, for example, a region in which the second electrode 52 is formed. As illustrated in FIG. 14A, the insulating layer forming solution 36 is applied, for example, on the porous alumina layer 32 and the side surfaces of the plurality of pores 34.

Figure 14B:
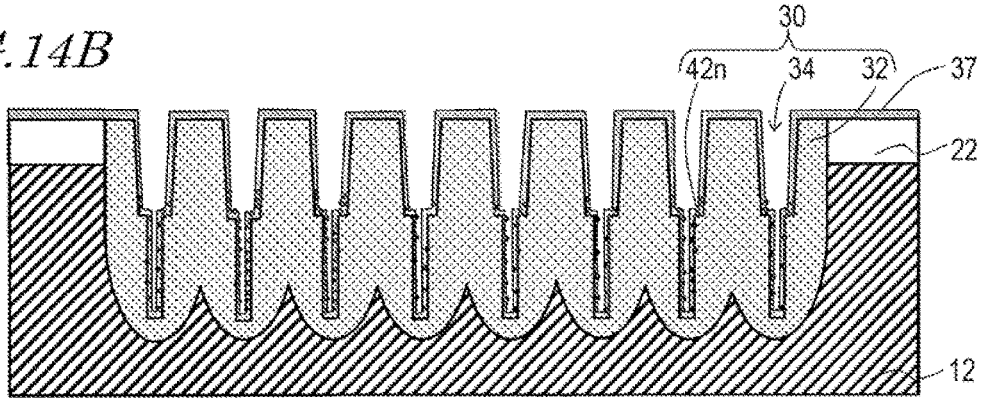

Subsequently, a solvent included in the insulating layer forming solution 36 is at least reduced to form an insulating layer 37 as illustrated in FIG. 14B. That is, the solvent included in the insulating layer forming solution 36 is reduced or removed to form the insulating layer 37. The insulating layer 37 formed here may include the solvent included in the insulating layer forming solution 36, but the solvent included in the insulating layer 37 is reduced to be less than the solvent that has been included in the insulating layer forming solution 36.

When the insulating layer 37 includes a solvent, after the second electrode 52 is formed, for example, forming treatment may be performed to further reduce the solvent included in the insulating layer 37. For example, forming treatment may be performed to perform baking of the insulating layer 37.

Figure 14C:
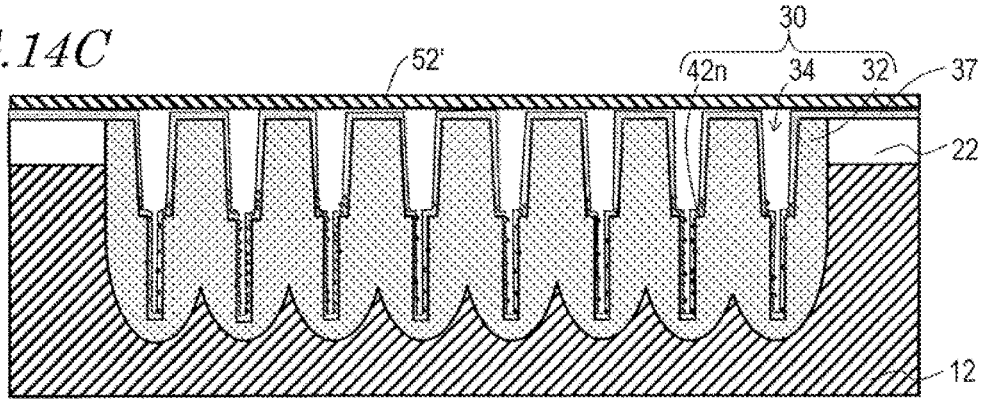

Next, as illustrated in FIG. 14C, a conductive film 52' is deposited on the insulating layer 37 by, for example, sputtering.

Figure 14D:
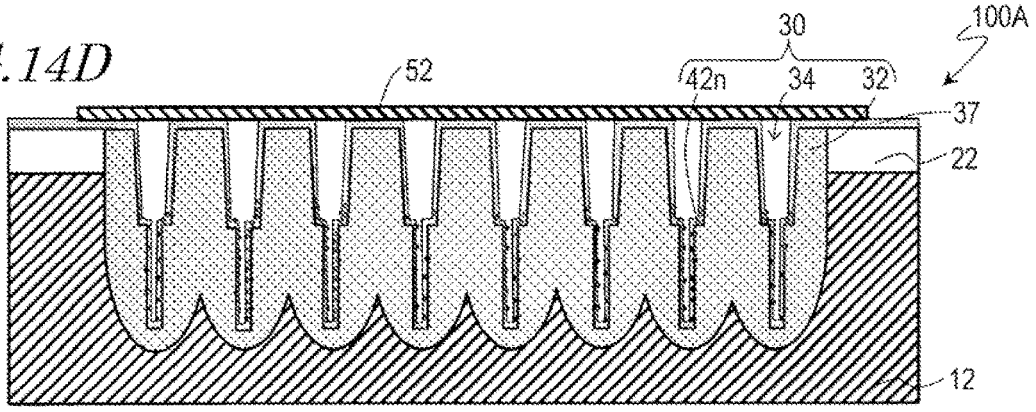

After that, the conductive film 52' is patterned as illustrated in FIG. 14D to form the second electrode 52.

In this manner, the electron emission device 100A is manufactured.

As described above, in the electron emission device manufactured by the above-mentioned method, the occurrence of the problem, of the failure of normal drive was suppressed. According to the investigation of the inventors of the subject application, it was found that the reason why the sampled electron emission device was not normally driven was considered to be because the conductivity of the semi-conductive layer 30 rose and/or the insulating property of the insulating layer 22 formed between the first electrode 12 and the second electrode 52 reduced. For example, in a process of manufacturing the electron emission device, when the Ag nanoparticles being conductive fine particles are excessively added, to the porous alumina layer 32, the conductivity of the semi-conductive layer 30 may excessively rise. Further, for example, when the insulating layer 22 is the anodized layer 22 not subjected to sealing treatment, it is considered that a material of vapor deposition used when the conductive film for forming the second electrode 52 is deposited and/or the Ag nanoparticles adhere and are diffused in the insulating layer (anodized layer) 22, and thus the insulating property of the anodized layer 22 may be reduced. When the second electrode 52 includes metal, the conductive film for forming the second electrode 52 includes metal. The method of forming the second electrode 52 is not limited to this example. The above is a consideration of the inventors of the subject application, and the present invention is not limited thereto.

In contrast, in the manufacturing method described with reference to FIG. 13A to FIG. 13E and FIG. 14A to FIG. 14D, before the second electrode 52 is formed, the insulating layer forming solution 36 is applied to substantially the entire surface of the aluminum substrate 12. The electron emission device 100A manufactured by this method differs from, for example, the electron emission device 100 illustrated in FIG. 1 in that the electron emission device 100A further includes the insulating layer 37 formed on the porous alumina layer 32 and in the plurality of pores 34. When the electron emission device 100A includes the insulating layer 37 formed of the insulating layer forming solution 36, even in a case in which the conductivity of the semi-conductive layer 30 rises and/or the insulating property of the insulating layer 22 decreases, the first electrode 12 and the second electrode 52 can be appropriately insulated from each other. As a result, it is possible to obtain the electron emission device capable of suppressing occurrence of the problem of the failure of normal drive.

The insulating layer forming solution 36 includes, for example, a polymer including a siloxane bond (sometimes referred to as "polysiloxane-based compound"), and a solvent. The polysiloxane-based compound may also be, for example, a polymer in which a siloxane bond is three-dimensionally formed with a reactive group such as a silanol group of polysiloxane serving as a cross-linking point.

As the insulating layer forming solution 36, for example, OCD T-12 1200V produced by TOKYO OHKA KOGYO CO., LTD. can be used. OCD T-12 1200V is expressed as $(HSiO_{1.5})_n$, and terminal —OH groups are condensed by heating (baking) so that a three-dimensional mesh structure can be formed. The chemical formula of OCD T-12 1200V is shown in [Chem. 1]. When OCD T-12 1200V is used as the insulating layer forming solution 36, the insulating layer forming solution 36 and the insulating layer 37 include a polymer including a siloxane bond, and the insulating layer 37 substantially does not include carbon.

[Chem. 1]

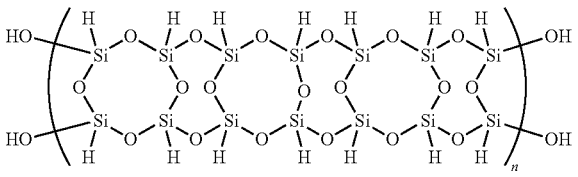

Alternatively, as the insulating layer forming solution 36, a hybrid material of an inorganic material and an organic material may be used. As the hybrid material of an inorganic material and an organic material, for example, siloxane (for example, S03 series, S05 series, or S06 series produced by Merck Ltd.) or silazane can be used.

The aluminum substrate 12 is coated with the insulating layer forming solution 36 by, for example, spin coating. Depending on the conditions of the spin coating, the thickness of the insulating layer forming solution 36 applied onto the aluminum substrate 12 can be adjusted. Further, when the insulating layer forming solution 36 is diluted with a solvent, the thickness of the insulating layer 37 to be formed can be reduced.

Also in the manufacturing method described with reference to FIG. 13A to FIG. 13E and FIG. 14A to FIG. 14D, instead of the aluminum substrate, an aluminum layer formed on a substrate (for example, a glass substrate) may be used.

Figure 15A:
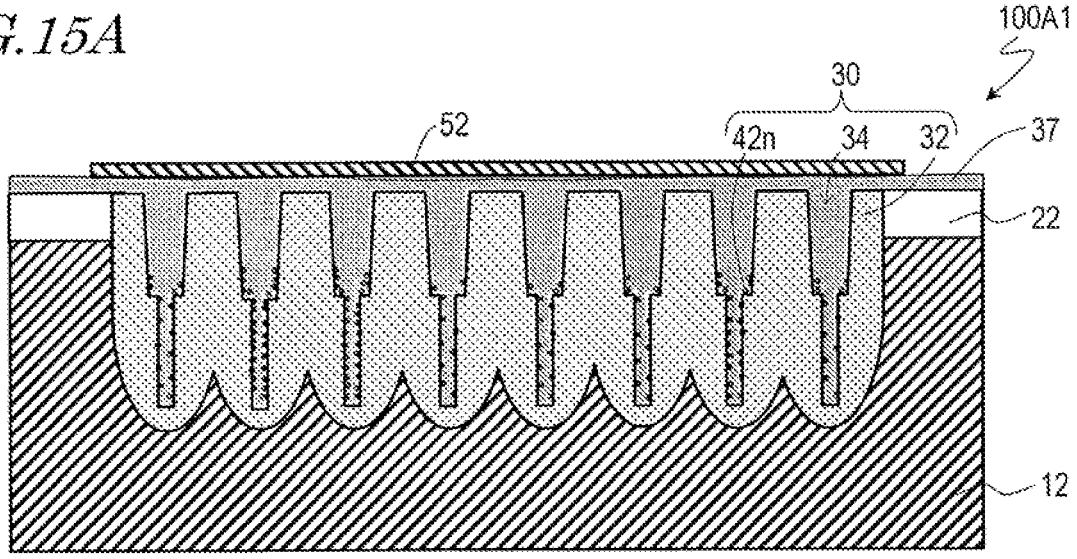
FIG. 15A is a schematic sectional view for illustrating an electron emission device 100A1 according to another embodiment of the present invention.
Figure 15B:
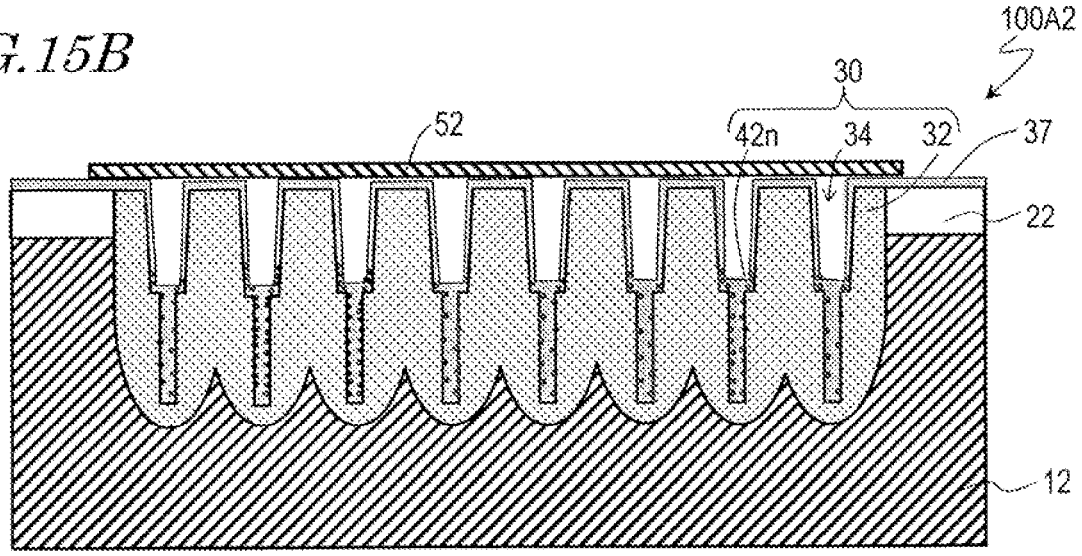
FIG. 15B is a schematic sectional view for illustrating an electron emission device 100A2 according to still another embodiment of the present invention.

With reference to FIG. 15A and FIG. 15B, description is given of other examples of the structure of the electron emission device manufactured by the method described with reference to FIG. 13A to FIG. 13E and FIG. 14A to FIG. 14D. FIG. 15A and FIG. 15B are sectional views for schematically illustrating electron emission devices 100A1 and 100A2, respectively.

As illustrated in FIG. 14C, the insulating layer 37 of the electron emission device 100A is formed on the porous alumina layer 32 and the side surfaces of the plurality of pores 34. In contrast, as illustrated in FIG. 15A, the insulating layer 37 of the electron emission device 100A1 is formed so as to almost completely fill the plurality of pores 34 while being formed on the porous alumina layer 32.

As illustrated in FIG. 15B, the insulating layer 37 of the electron emission device 100A2 is applied so as to partially fill the plurality of pores 34 (that is, to the middle in the depth direction) while being formed on the porous alumina layer 32 and the side surfaces of the of plurality of pores 34.

The embodiments of the present invention are not limited to the illustrated examples. For example in the drawings, the insulating layer 37 is formed so as to cover all the side surfaces of the pores 34, but the embodiments of the present invention axe not limited thereto.

The electron emission device was manufactured by the method described with reference to FIG. 13A to FIG. 13E and FIG. 14A to FIG. 14D, and was evaluated. The electron emission device here was manufactured as follows. Conditions other than those described below are the same as those of the electron emission device 100 described with reference to FIG. 7 and FIG. 8.

Insulating layer forming solution 36: solution obtained by diluting OCD T-12 1200V, which is produced by TOKYO OHKA KOGYO CO., LTD. and diluted $(HSiO_{1.5})_n$ 5 times with propylene glycol monomethyl ether acetate (PGMEA), 3 times with PGMEA (solvent)

Method of applying insulating layer forming solution 36: spin coating (3,000 rpm for 30 seconds)

Method of forming insulating layer 37: insulating layer forming solution 36 is naturally dried Thickness of insulating layer 37: 5.00 nm In the electron emission device manufactured by the method described with reference to FIG. 13A to FIG. 13E and FIG. 14A to FIG. 14D, the occurrence of the problem of the failure of normal drive was suppressed as compared to the electron emission device 100 described, with reference to FIG. 7 and FIG. 8.

The above-mentioned manufacturing method can be widely applied to a method of manufacturing an electronic device and is not limited to a method of manufacturing an electron emission device. In particular, the above-mentioned manufacturing method can be applied to a method of manufacturing an electronic device including a porous alumina layer having a plurality of pores, which is obtained by subjecting a surface of an aluminum substrate or a surface of an aluminum layer supported by a substrate to anodization. When this manufacturing method is applied, even in a case in which the insulating property of the porous alumina layer is reduced for some reason (for example, for some reason in the manufacturing process), the occurrence of the problem that the manufactured electronic device is not normally driven can be suppressed.

As such an electronic device, for example, a localized surface plasmon resonance device is given. This is a sensing device using localized surface plasmon resonance caused by metal nanoparticles (resonance caused by free electrons on surfaces of metal nanoparticles to an external field having a specific frequency). There has been proposed a localized, surface plasmon resonance device using metal nanoparticles that can be regularly arranged by applying the metal nanoparticles into the plurality of pores of the porous alumina layer.

The method of manufacturing an electronic device according to an embodiment of the present invention includes the following step (a) to step (e).

Step (a): step of providing the aluminum substrate or the aluminum layer supported by the substrate Step (b): step of forming the porous alumina layer having the plurality of pores by anodizing the surface of the aluminum substrate or the surface of the aluminum layer Step (c): step of applying, after the step (b), the insulating layer forming solution to substantially the entire surface of the aluminum substrate or the aluminum layer Step (d): step of forming, after the step (c), the insulating layer by at least reducing the solvent included in the insulating layer forming solution Step (e): step of forming, after the step (d), the semiconductor layer or the conductive layer on the insulating layer In this case, "substantially the entire surface" in the step (c) at least includes a region in which a region to function as the electronic device is to be formed.

The embodiments of the present invention are suitably used as, for example, an electron emission device to be used for a charging device of an image forming apparatus and a method of manufacturing the electron emission device.

While the present invention has been described with respect to exemplary embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This application is based on Japanese Patent Applications No. 2017-174115 filed on Sep. 11, 2017, the entire contents of which are hereby incorporated by reference.

What is claimed is:

1. A method of manufacturing an electron emission device, comprising:

a step A of providing one of an aluminum substrate and an aluminum layer supported by a substrate;

a step B of anodizing a surface of the one of the aluminum substrate and the aluminum layer to form a porous alumina layer having a plurality of pores;

a step C of applying silver nanoparticles into the plurality of pores to cause the plurality of pores to support the silver nanoparticles;

a step D of applying, after the step C, an insulating layer forming solution to substantially an entire surface of the one of the aluminum substrate and the aluminum layer;

a step E of forming, after the step D, an insulating layer by at least reducing a solvent included in the insulating layer forming solution; and a step F of forming, after the step E, an electrode on the insulating layer.

2. The method of manufacturing an electron emission device of claim 1, wherein the step D includes performing one of coating and printing of the insulating layer forming solution.

3. The method of manufacturing an electron emission device of claim 1, wherein the step D includes coating substantially the entire surface with the insulating layer forming solution by spin coating.

4. The method of manufacturing an electron emission device of claim 1, wherein the step F includes:

a step F1 of depositing a conductive film on the insulating layer; and a step F2 of patterning the conductive film to form the electrode.

5. The method of manufacturing an electron emission device of claim 1, wherein the electrode includes metal.

6. The method of manufacturing an electron emission device of claim 1, wherein the surface of the one of the aluminum substrate and the aluminum layer provided in the step A is partially covered by an interelectrode insulating layer.

7. The method of manufacturing an electron emission device of claim 6, wherein the step A includes:

a step A1 of providing the one of the aluminum substrate and the aluminum layer supported by the substrate; and a step A2 of forming the interelectrode insulating layer, the step A2 including forming the interelectrode insulating layer including an anodized layer formed by anodizing a part of the surface of the one of the aluminum substrate and the aluminum layer provided in the step A1.

8. The method of manufacturing an electron emission device of claim 1, wherein the step E includes baking the insulating layer forming solution.

9. The method of manufacturing an electron emission device of claim 1, wherein the step E includes baking the insulating layer forming solution at 220° C. or less.

10. The method of manufacturing an electron emission device of claim 1, wherein the step E includes baking the insulating layer forming solution at a temperature equal to or higher than a boiling point of the solvent.

11. The method of manufacturing an electron emission device of claim 1, wherein the insulating layer forming solution includes a polymer including a siloxane bond.

12. The method of manufacturing an electron emission device of claim 1, wherein the step B further includes performing etching after the anodization.

13. The method of manufacturing an electron emission device of claim 12, wherein the step B further includes performing anodization after the etching.

14. A method of manufacturing an electronic device, comprising:

a step (a) of preparing one of an aluminum substrate and an aluminum layer supported by a substrate;

a step (b) of anodizing a surface of the one of the aluminum substrate and the aluminum layer to form a porous alumina layer having a plurality of pores;

a step (c) of applying, after the step (b), an insulating layer forming solution to substantially an entire surface of the one of the aluminum substrate and the aluminum layer;

a step (d) of forming, after the step (c), an insulating layer by at least reducing a solvent included in the insulating layer forming solution; and a step (e) of forming, after the step (d), one of a semiconductor layer and a conductive layer on the insulating layer.

* * * * *